US007287850B2

(12) United States Patent
Matsui et al.

(10) Patent No.: US 7,287,850 B2
(45) Date of Patent: Oct. 30, 2007

(54) PORTABLE ELECTRONIC APPARATUS

(75) Inventors: Motoyuki Matsui, Akishima (JP); Atsushi Oshiro, Kokubunji (JP); Masatoshi Ohtaka, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 307 days.

(21) Appl. No.: 11/038,672

(22) Filed: Jan. 19, 2005

(65) Prior Publication Data

US 2005/0162497 A1 Jul. 28, 2005

(30) Foreign Application Priority Data

Jan. 22, 2004 (JP) ..... 2004-014505
Apr. 5, 2004 (JP) ..... 2004-111012

(51) Int. Cl.
*B41J 29/13* (2006.01)
*B41J 3/36* (2006.01)

(52) U.S. Cl. ..... 347/109; 347/108

(58) Field of Classification Search ..... 347/108, 347/109; 346/145, 143; 400/88, 691
See application file for complete search history.

(56) References Cited

U.S. PATENT DOCUMENTS 4,663,638 A 5/1987 Hirose
4,772,147 A * 9/1988 Ohtani ..... 400/690.1
5,455,616 A * 10/1995 Ozawa et al. ..... 347/104
5,910,882 A * 6/1999 Burrell ..... 361/681
6,004,053 A 12/1999 Petteruti et al.
6,118,469 A 9/2000 Hosomi
6,155,730 A * 12/2000 Nakayama et al. ..... 400/613
6,261,013 B1 * 7/2001 Bryer et al. ..... 400/613
6,443,645 B1 9/2002 Takei et al.
6,607,316 B1 8/2003 Petteruti et al.
6,609,844 B1 8/2003 Petteruti et al.
6,991,159 B2 * 1/2006 Zenou ..... 235/383
7,033,097 B2 * 4/2006 Petteruti et al. ..... 400/693
7,040,822 B2 * 5/2006 Fries et al. ..... 400/88
7,073,717 B1 * 7/2006 Arnold et al. ..... 235/472.01
7,116,344 B2 * 10/2006 Shimoda ..... 347/222
2002/0024578 A1 * 2/2002 Yamashita ..... 347/108
2004/0066447 A1 * 4/2004 Arnold ..... 347/109

FOREIGN PATENT DOCUMENTS

JP 2001-130057 A 5/2001
JP 2002-193499 A 7/2002

* cited by examiner

*Primary Examiner*—Stephen Meier
*Assistant Examiner*—Leonard Liang
(74) *Attorney, Agent, or Firm*—Frishauf, Holtz, Goodman & Chick, P.C.

(57) ABSTRACT

A portable electronic apparatus includes a printer portion provided in a main body and having a printing head, a recording paper holder provided in a portion of the main body near to the printer portion, a holder cover openably attached to the paper holder, a platen provided on the holder cover and facing the printing head when the holder cover covers the paper holder, and a paper sensor provided on the holder cover, located near to the platen, and detecting the recording paper. The apparatus may includes a water-drop proof cover removably attached on the main body, covering a portion of the outer surface region of the main body which faces the printed recording paper discharged out from a recording paper discharge port formed in the portion of the outer surface region, and housing the printed recording paper discharged out from the paper discharge port.

4 Claims, 26 Drawing Sheets

PORTABLE ELECTRONIC APPARATUS

CROSS-REFERENCE TO RELATED APPLICATIONS

This application is based upon and claims the benefit of priority from prior Japanese Patent Applications No. 2004-014505, filed Jan. 22, 2004; and No. 2004-111012, filed Apr. 5, 2004, the entire contents of both of which are incorporated herein by reference.

BACKGROUND OF THE INVENTION

1. Field of the Invention

The present invention relates to a portable electronic apparatus such as a portable information terminal.

2. Description of the Related Art

A conventional portable information terminal has a main body of the size held by one hand. The main body contains a printer and a paper holder provided in proximity to the printer to hold a roll of recording paper. The main body can be operated by the other hand while the main body is held by one hand.

In such a conventional portable information terminal, a paper is fed from a roll of recording paper held in the paper holder to a clearance between the printing head and a platen of the printer by a pair of paper feed rollers. The printing head prints information on the recording paper fed thereto, and the printed recording paper is discharged to the outside of the main body.

A frame to divide the paper holder from the printer is rotatably fixed to the paper holder. When a roll of recording paper is loaded in the paper holder, the frame is rotated and separated from the printer to open the paper holder to the printer. After the recording paper is loaded, the frame is returned to the original position between the printer and the paper holder, and the part of the frame facing to the printing head of the printer serves as a platen.

The following roller of the paired paper feed rollers is attached to the frame. The driving roller of the paired paper feed rollers is attached to a main body case of the main body. The following roller is pressed to the driving roller attached to the main body case with the recording paper being interposed therebetween, when the frame is placed between the printer and the paper holder and the platen of the frame is opposed to the printing head of the printer. The following roller is rotated together with the driving roller, and the recording paper is fed to the clearance between the printing head of the printer and the platen of the frame.

In such a conventional portable information terminal, in order to facilitate the use of the recording paper, it is preferable that a start position mark to find a start position of the recording paper and a residual amount indicating mark to indicate a residual amount of the recording paper are mounted on the back surface of the recording paper (the surface not facing to the printing head) and a sensor to detect these marks on the back surface of the recording paper is provided in the main body.

However, in the above-mentioned conventional portable terminal, the sensor is provided in the area of the main body located in the backside of the recording paper to escape from the moving trace of the frame having the platen and the following roller when the frame is opened and closed. This increases the size of the main body.

Besides, the conventional portable information terminal as described above has a water-drop proof cover which covers only a paper discharge port and the part neighboring thereto on the upper surface of the main body. The printed recording paper discharged from the paper discharge port is sent to the distal end portion of the upper surface of the main body. If the printed recording paper is long, the printed recording paper hangs down from the distal end portion of the upper surface of the main body, and the hang-down portion of the printed recording paper is exposed to the outside of the water-drop proof cover. Thus, when the conventional portable information terminal is used outdoors in a rainy day, the portion of the printed recording paper exposed to the outside of the water-drop proof cover is wetted by rainwater.

BRIEF SUMMARY OF THE INVENTION

According to one aspect of the invention, a portable electronic apparatus comprises: a main body; a printer portion provided in the main body and having at least a printing head; a paper holder provided in a portion of the main body near to the printer portion and holding a recording paper; a holder cover openably attached to the paper holder; a platen provided on the holder cover and facing the printing head when the holder cover covers the paper holder; and a paper sensor provided on the holder cover, located near to the platen, and detecting the recording paper.

According to another aspect of the invention, a portable electronic apparatus comprises: a main body including a first surface, a second surface positioned in the opposite side of the first surface, and a recording paper discharge port formed in the first surface; a printer portion provided in the main body, including a printing head, the printing head being used to print information on a recording paper, and discharging the printed recording paper from the paper discharge port in the first surface of the main body; a paper holder provided in a portion of the main body near to the printer portion and holding a recording paper to be supplied to the printer portion; a holder cover openably attached to the paper holder; a platen provided on the holder cover and facing the printing head when the holder cover covers the paper holder; a paper sensor provided in a portion of the holder cover near to the platen and detecting the recording paper; and a water-drop proof cover removably attached on the main body, and covering a portion of the outer surface region of the main body and the paper holder, both of the portion of the outer surface region of the main body and the paper holder facing the printed recording paper discharged out from the recording paper discharge port, the portion of the outer surface region of the main body including a part of the first surface and a part of the second surface, and the water-drop proof cover housing the printed recording paper discharged out from the paper discharge port.

According to a further aspect of the invention, a portable electronic apparatus comprises: a main body including a first surface, a second surface positioned in the opposite side of the first surface, and a recording paper discharge port formed in the first surface; a printer portion including a printing head, the printing head printing information on a recording paper, and discharging out the printed recording paper from the paper discharge port in the first surface of the main body; and a water-drop proof cover removably attached on the main body, and covering a portion of the outer surface region of the main body which faces the printed recording paper discharged out from the recording paper discharge port, the portion of the outer surface region of the main body including a part of the first surface and a part of the second surface, and the water-drop proof cover housing the printed recording paper discharged out from the paper discharge port.

According to a more further aspect of the invention, a portable electronic apparatus comprises: a main body including a first surface, a second surface positioned in the opposite side of the first surface, and a recording paper discharge port formed in the first surface; a printer portion provided in the main body, including a printing head, the printing head being used to print information on a recording paper, and discharging the printed recording paper from the paper discharge port in the first surface of the main body; a paper holder provided in a portion of the main body near to the printer portion and holding a recording paper to be supplied to the printer portion; a holder cover openably attached to the paper holder; a platen provided on the holder cover and facing the printing head when the holder cover covers the paper holder; and a water-drop proof cover removably attached on the main body, and covering a portion of the outer surface region of the main body and the paper holder, both of the portion of the outer surface region of the main body and the paper holder facing the printed recording paper discharged out from the recording paper discharge port, the portion of the outer surface region of the main body including a part of the first surface and a part of the second surface, and the water-drop proof cover housing the printed recording paper discharged out from the paper discharge port.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Now, a portable information terminal according to a first embodiment of a portable electronic apparatus of the present invention will be described with reference to FIGS. 1-11.

Figure 1:
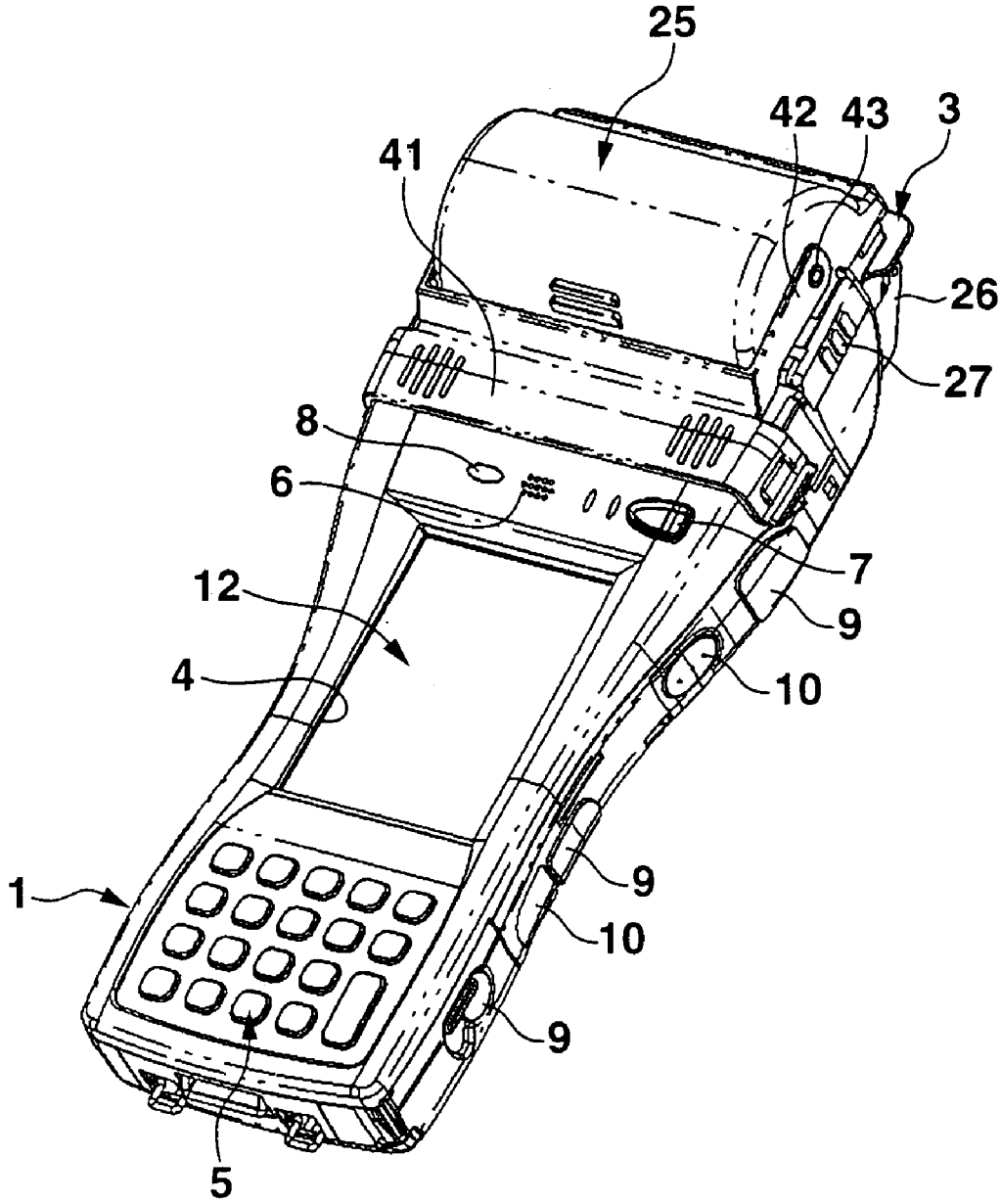
FIG. 1 is a perspective view of a portable information terminal according to a first embodiment of the present invention in its unused state.
Figure 2:
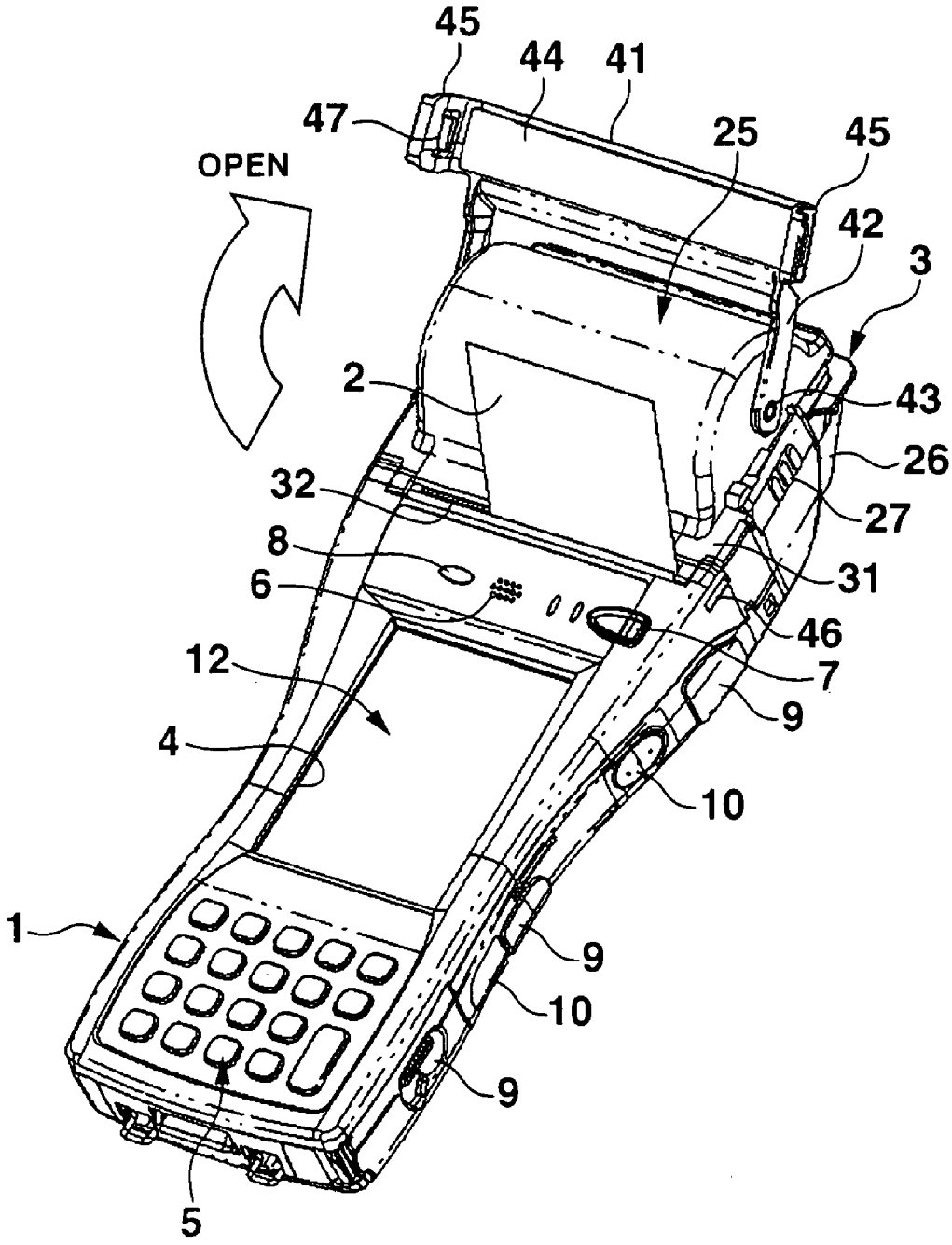
FIG. 2 is a perspective view showing the portable information terminal shown in FIG. 1 in its used state.

The portable information terminal has an oblong shaped main body case 1, as shown in FIGS. 1 and 2. The middle portion of the main body case 1 in its longitudinal direction is narrowed to allow a user to hold the middle portion by its hand. A paper holder 3 for holding a roll of recording paper 2 is provided at the distal end portion of the main body case 1.

At the middle of the upper surface of the main body case 1, an opening 4 is formed. At the proximal end portion of the upper surface of the main body case 1, a key input unit 5 with an array of various keys including character keys and numeric keys is provided. Further, at the middle of the upper surface of the main body case 1, holes 6 for speaker, a pushbutton switch 7 and a display lamp 8 are provided between the opening 4 and the paper holder 3. On one side surface of the main body case 1, a plurality of connectors 9 and various pushbutton switches 10 are provided.

Figure 3:
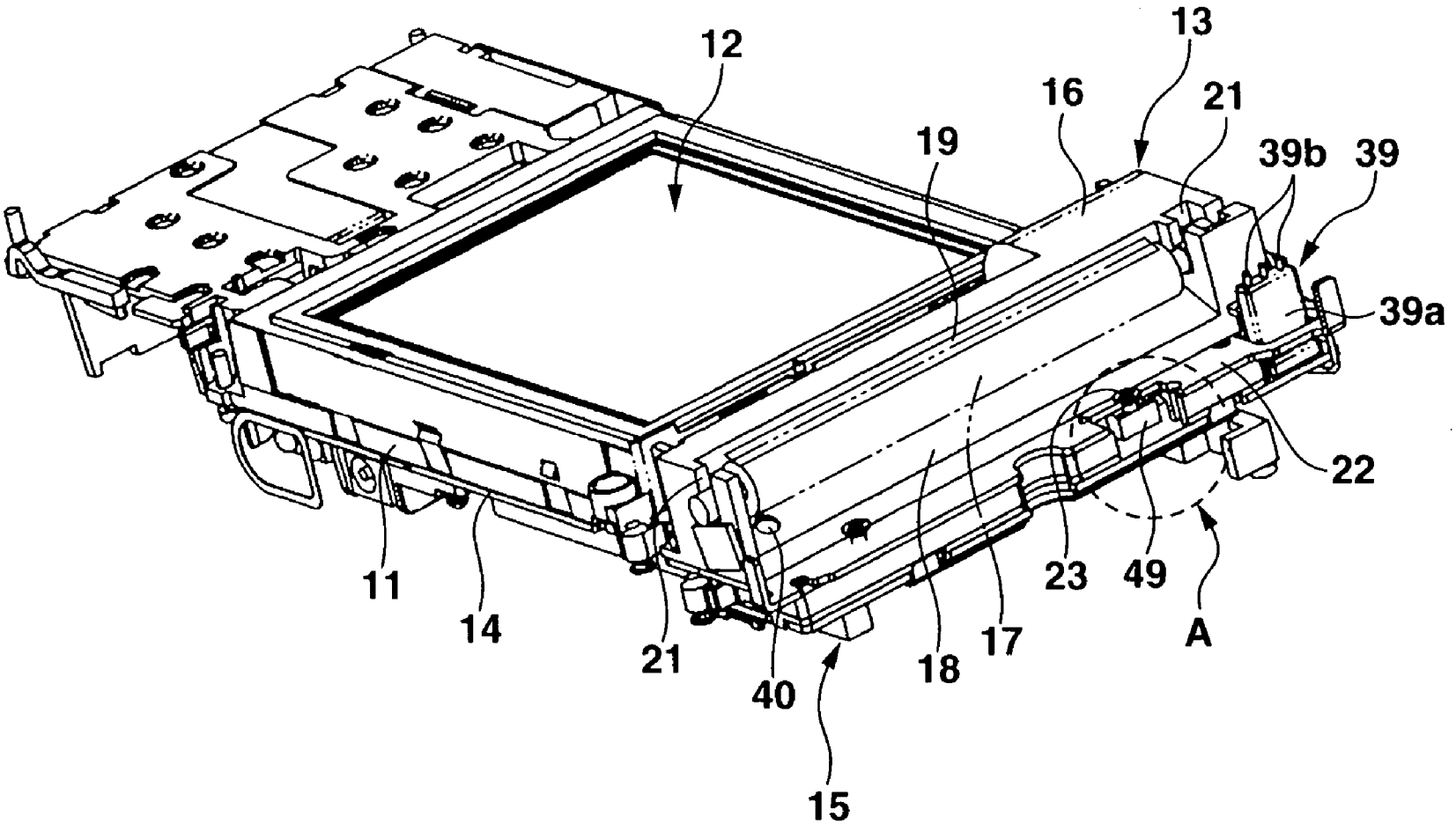
FIG. 3 is a perspective view showing an internal structure module of the portable information terminal shown in FIG. 1.

An internal structure module shown in FIG. 3 is provided in the main body case 1. The module has an inner case 11. An input display unit 12 is provided at the center of the inside case 11 to correspond to the opening 4 formed in the middle of the upper surface of the main body case 1. The input display unit 12 includes a display panel and a transparent touch panel placed on the upper surface of the display panel. When the touch panel of the input display unit 12 is operated with an input pen or a fingertip through the opening 4 at the middle of the upper surface of the main body case 1, the information entered by this input operation is displayed on the display panel, and the user can see the information displayed on the display panel from the outside of the main body case 1 through the transparent touch panel. The display panel of the input display unit 12 is composed of, for example, a liquid crystal display element or an electroluminescence display element.

A printer unit 13 is provided at one end portion (at the right end portion in FIG. 3) of the inner case 11 corresponding to the distal end portion of the main body case 1. A circuit board 14 is provided on the lower surface of the inside case 11. A card holder 15 in which a communication card (not shown) is detachably inserted is provided on the lower side of the circuit board 14 along the longitudinal direction of the main body case 1. As shown well in FIG. 5, the printer unit 13 and the card holder 15 are opened in the distal end side (the right end in FIG. 5) of the main body case 1.

Figure 4:
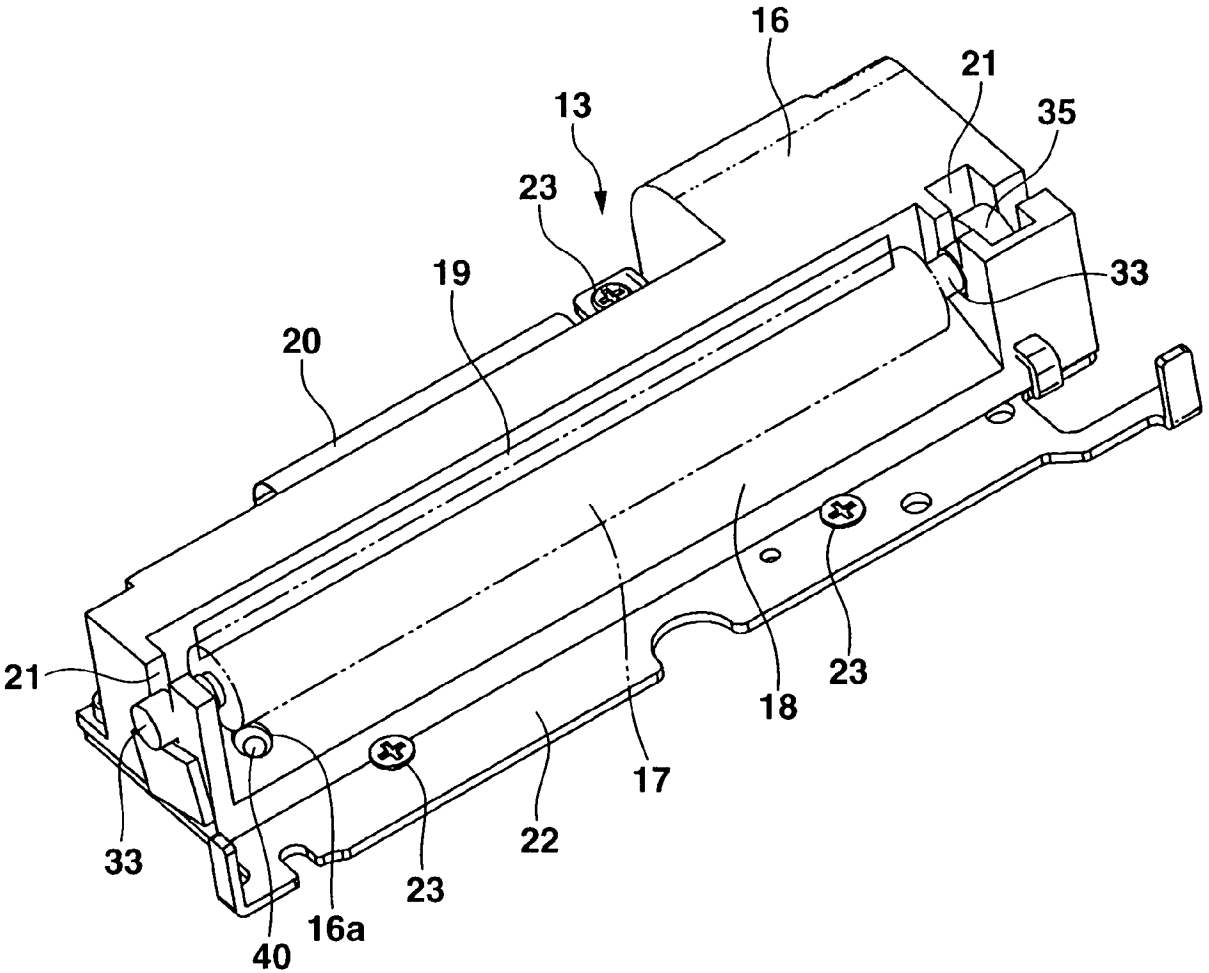
FIG. 4 is a perspective view showing a printer unit included in the internal structure module shown in FIG. 3.

The printer unit 13 has a unit main body 16 as shown in FIGS. 3 and 4. A paper guide concave 18 in which a platen roller 17 is detachably inserted and which guide the recording paper 2 inserted therein is provided to open in the upper surface and end-face of the unit main body 16. A printing head 19 is provided on the surface of the paper guide concave 18 to face the platen roller 17 inserted into the paper guide concave 18. The printing head 19 is electrically connected to the circuit board 14 by a flexible wiring board 20. The printing head 19 is heated in accordance with printing data sent from the circuit board 14, and prints information corresponding to the printing data on the recording paper 2 inserted into the clearance between the printing head 19 and the platen roller 17.

Figure 5:
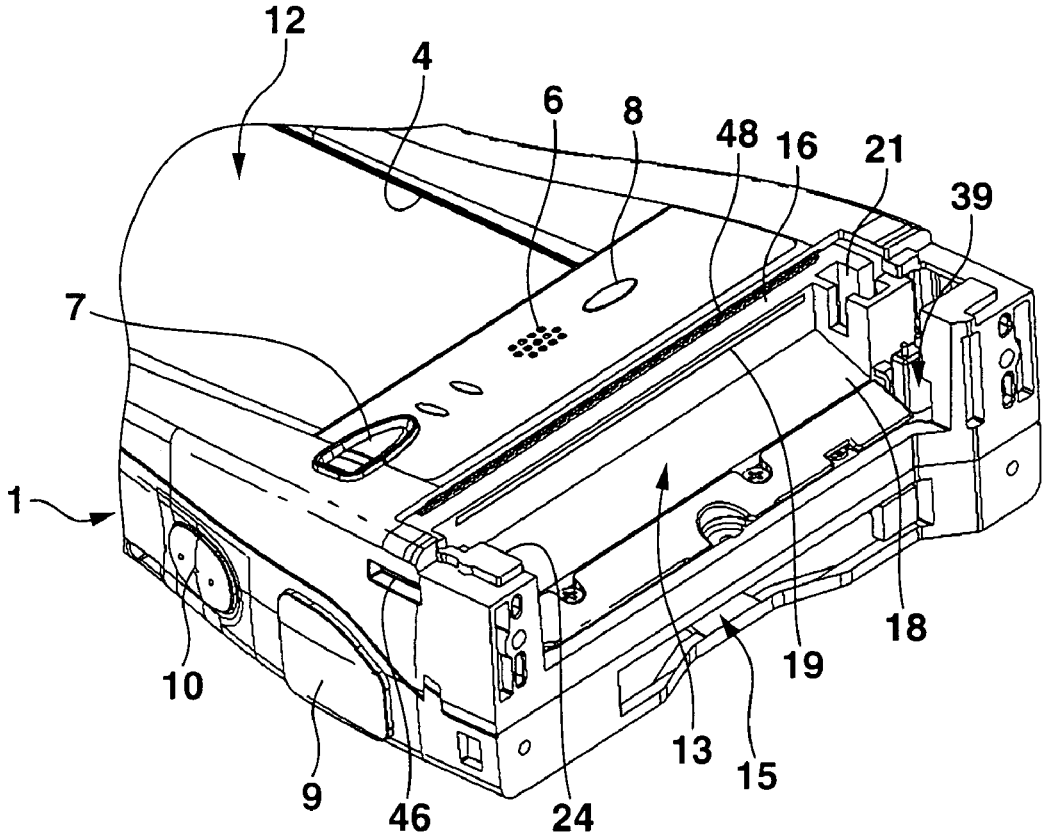
FIG. 5 is an enlarged perspective view showing a state that the printer unit shown in FIG. 4 is placed in a main body case of the portable information terminal shown in FIG. 1.

Platen roller guides 21 are provided in the both side portions of the surface of the paper guide concave 18 in the unit main body 16 to locate the platen roller 17 at a give position in the paper guide concave 18, that is, the position of the surface of the paper guide concave 18 at which the platen roller 17 faces the printing head 19. The main body unit 16 is attached on a metallic reinforcing plate 22, and the reinforcing plate 22 is fixed to the inner case 11 with metallic screws 23. Thus, as shown in FIG. 5, the main body unit 16 is placed in the main body case 1 to expose the paper guide concave 18 to the outside through a printer exposing opening 24 provided in the distal end portion of the main body case 1.

When the communication card (not shown) is inserted into the insertion slot of the card holder 15 opened in the distal end portion (the right end in FIG. 5) of the main body case 1, the communication card is electrically connected to a card connector (not shown) provided in the inner end of the card holder 15. Thus, the portable information terminal can send and receive data to/from an external apparatus (not shown). The card connector provided position is previously determined by an adapter or the like in the card holder 15 in accordance with the length of the communication card to be inserted. As a result, when the communication card (not shown) is inserted into the card holder 11 and connected to the card connector, the communication part of the communication card (not shown) is projected out from the distal end portion of the main body case 1 and the projected communication part of the communication card (not shown) is located under the paper holder 3 provided on the distal end portion of the main body case 1.

The paper holder 3 is fixed to the distal end portion (the right end in FIG. 6) of the main body case 1 with fixing screws (not shown). A holder cover 25 is rotationally attached on the upper part of the paper holder 3. A card cover 26 is rotationally attached on the lower part of the paper holder 3. Further, lock members 27 for locking the holder cover 25 at the closed position are provided on both side surfaces of the paper holder 3 to be slidable in the back and forth directions of the paper holder 3 (in the right and left directions in FIGS. 8 and 9).

The holder cover 25 is formed to have a semi-cylindrical shape with its convex side up. A holder arm 28 is provided on the rear end (the right end in FIG. 8 and the left end in FIG. 9) of the holder cover 25. The holder arm 28 is rotatably attached to a hinge projection provided at the rear end (the right end in FIG. 8 and left end in FIG. 9) of the paper holder 3. The holder cover 28 is rotated in the vertical direction around the holder arm 28 on the hinge projection at the rear end of the paper holder 3 to open and close the paper holder 3. The upper portion (the upper portion of the right end in FIG. 8, and the upper portion of the left end in FIG. 9) of the rear end of the card cover 26 is rotatably fixed to a hinge shaft 29 provided at the upper portion of the rear end (the upper portion of the right end in FIG. 8, and the upper portion of the left end in FIG. 9) of the paper holder 3. As a result, the card cover 26 is rotational between a closed position at which the card cover 26 covers the projected communication part of the communication card inserted into the card holder 11 and an open position at which the card cover 26 dose not cover the projected communication part of the communication card inserted into the card holder 11.

Figure 6:
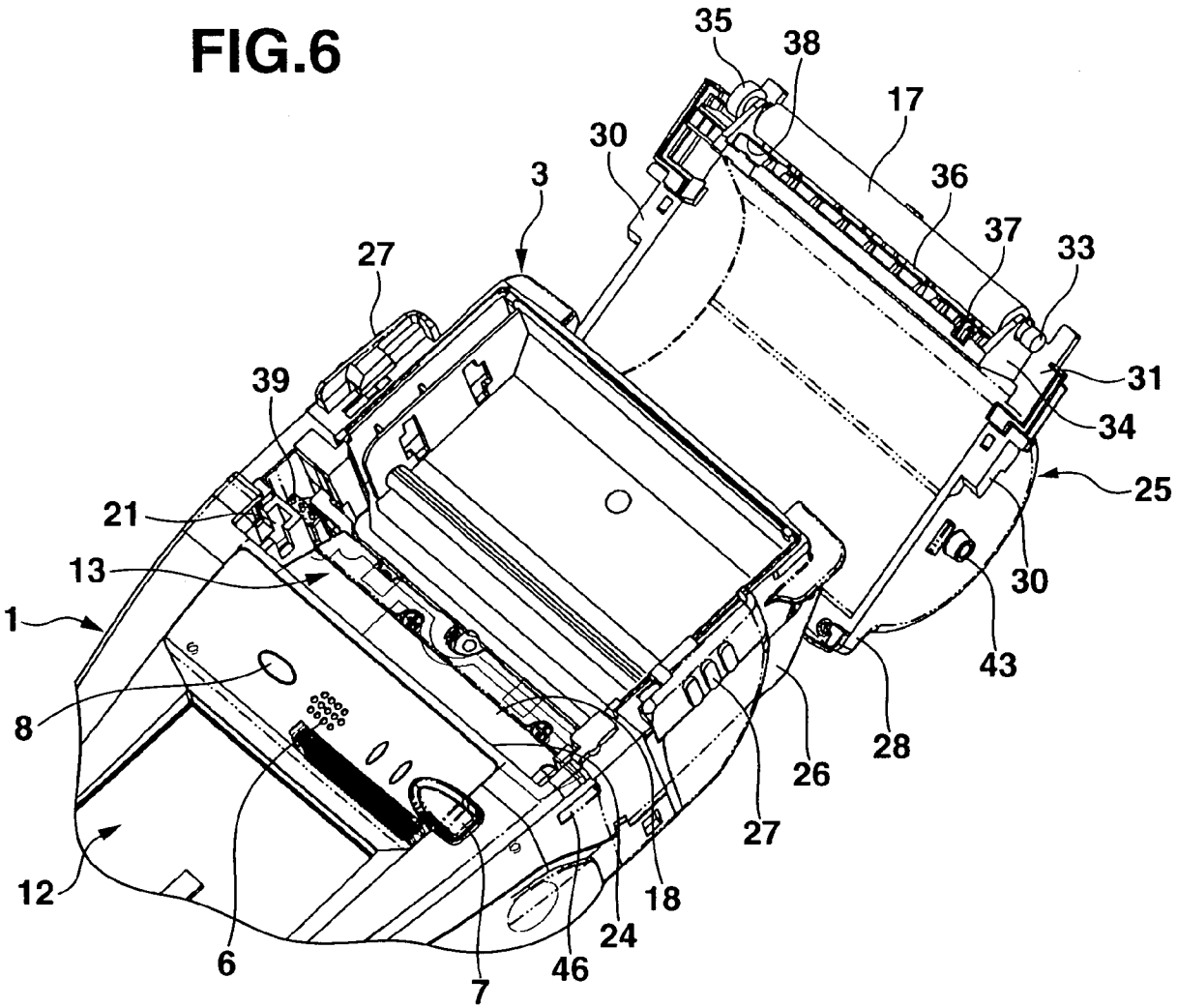
FIG. 6 is an enlarged perspective view showing a state that a holder cover of a paper holder of the portable information terminal shown in FIG. 1 is opened.

As shown in FIG. 6, engaging projections 30 for engaging with the lock members 27 on the both side surfaces of the paper holder 3 are formed on the front portions of the both side surfaces of the holder cover 25. As shown in FIGS. 2 and 6, a flange 31 for covering the printer exposing opening 24 of the main body case 1 is provided at the front end of the holder cover 25. The flange 31 is provided with a paper discharge port 32 for discharging the recording paper 2 printed by the printer unit 13 in the printer exposing opening 24 upward from the main body case 1. The platen roller 17 is rotatably attached on the lower surface of the flange 31.

Figure 7:
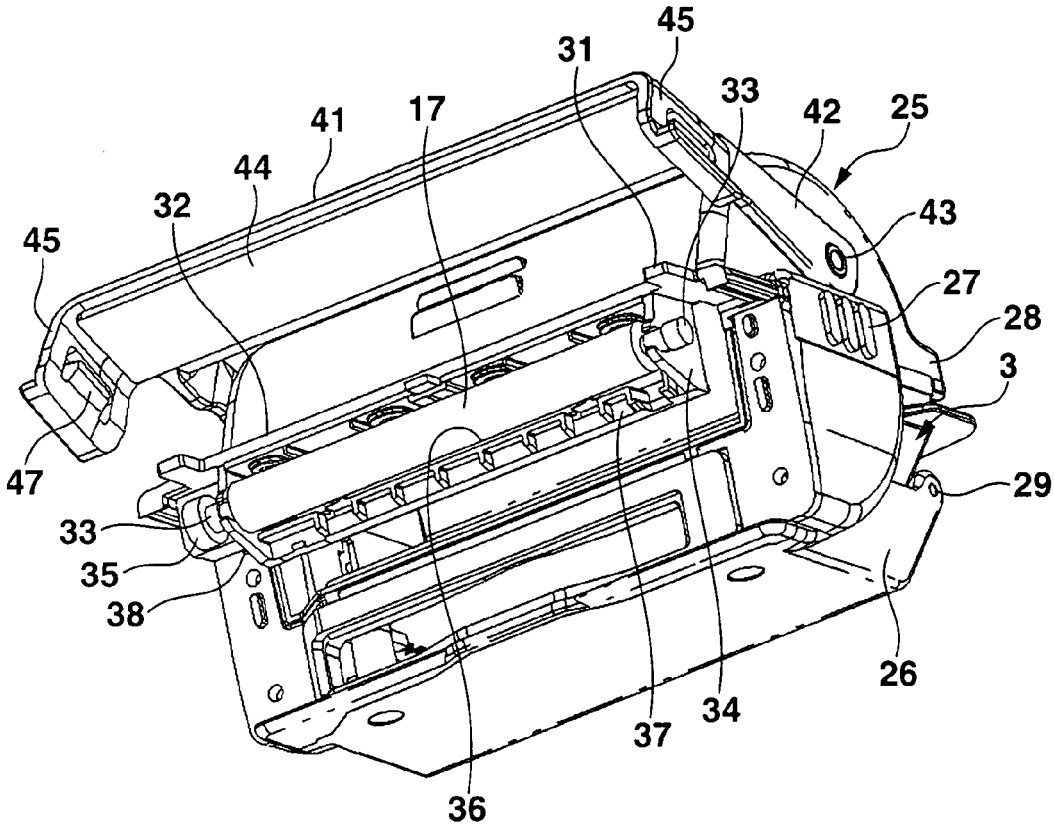
FIG. 7 is a perspective view showing the paper holder shown in FIG. 6 and a water-drop proof cover shown in FIG. 1.

As shown in FIG. 7, rotation center shafts 33 of the platen roller 17 projected out from the both longitudinal ends of the platen roller 17 are supported to be rotational by a platen roller support 34 formed on the lower surface of the flange 31 of the holder cover 25. When the holder cover 25 is rotated from the open position to the closed position at which the holder cover 25 covers the upper side of the paper holder 3, the platen roller 17 is inserted into the main body case 1 through the upper portion of the printer exposing opening 24, and the paired rotation shafts 33 are inserted in and guided by the Platen roller guides 21 on both sides of the surface of the paper guide concave 18 in the unit main body 16 of the printer unit 13 so that the platen roller 17 is arranged to face closely the printing head 19 in the paper guide concave 18. As shown in FIGS. 4, 6 and 7, a follower gear 35 is provided in one of the rotation shafts 33 of the platen roller 17. When the holder cover 25 is positioned at the closed position, the follower gear 35 engages with a driving gear (not shown) provided in the unit main body 16 of the printer unit 13. When the follower gear 35 is driven by the driving gear, the platen roller 17 is rotated to feed the recording paper 2 inserted into the clearance between the platen roller 17 and the printing head 19 while the recording paper 2 is pressed on the printing head 19 by the platen roller 17.

A sensor board 36 is provided on the lower surface of the flange 31 of the holder cover 25 along the platen roller 17. A first optical sensor 37 for detecting marks (not shown) provided on the back surface of the recording paper 2 (that is, the surface not facing the printing head 19) is provide on the lower surface of the sensor board 36. Connecting electrodes 38 are provided on one of the both side portions of the lower surface of the sensor board 36, and the connecting electrodes 38 are electrically connected to the first optical sensor 37 by a wiring pattern (not shown).

The first optical sensor 37 has a light-emitting element and a light-receiving element. The first optical sensor 37 applies the light emitted from the light-emitting element to the back surface of the recording paper 2 which is pulled out from the paper holder 3 and immediately before inserted into the clearance between the printing head 19 and the platen roller 17 in the paper guide concave 18, and receives the reflected light by the light-receiving element, thereby detecting the marks provided on the back surface of the recording paper 2. The marks are provided on the back surface of the recording paper 2, for example by printing, and include a start positioning mark to find a start position of the recording sheet 2 and a residual amount indicating mark to indicate the residual amount of recording paper 2.

When the holder cover 25 is positioned at the closed position, the connecting electrodes 38 of the sensor board 36 are in electrically contact with a connecting terminal portion 39 provided in one of both side portions of the printer exposing opening 24 of the unit main body 16 of the printer unit 13 in the main body case 1.

Figure 10A:
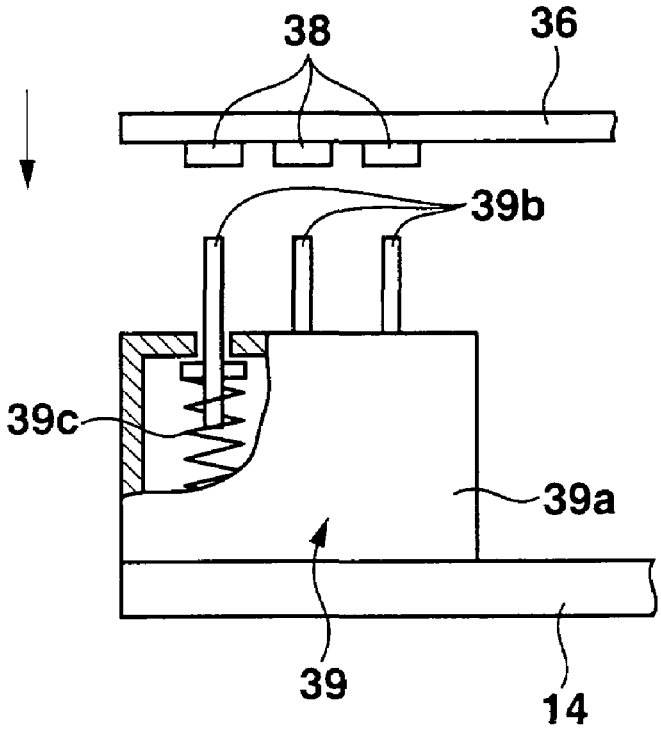
FIG. 10A is an enlarged view showing a sensor board provided on a platen of the paper holder and a main circuit board of the portable information terminal shown in FIG. 1, in which the sensor board of the paper holder is not electrically connected to the main circuit board of the portable information terminal.
Figure 10B:
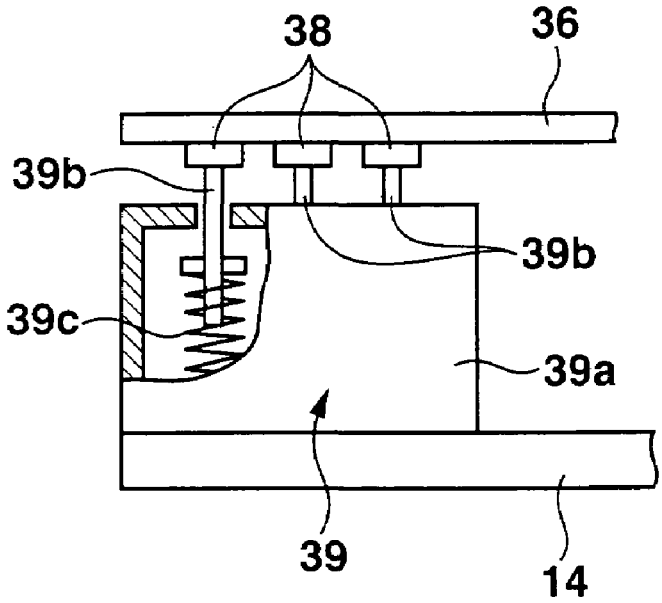
FIG. 10B is an enlarged view showing the sensor board of the paper holder and the main circuit board of the portable information terminal, in which the sensor board of the paper holder is electrically connected to the main circuit board of the portable information terminal.

The connecting terminal portion 39 includes a holding member 39*a* provided on the circuit board 14 in the main body case 1, and a plurality of contact pins 39*b* provided in the holding member 39*a* so as to be urged upward by coil springs 39*c*, as shown in FIG. 10A. When the holder cover 25 is positioned at the closed position and the connecting electrodes 38 of the holder cover 25 are pressed on the contact pins 39*b* of the connecting terminal portion 39, the contact pins 39*b* are pressed down against the urging forces of the coil springs 39*c*, as shown in FIG. 10B. However, the contact pins 39*b* are resiliently and securely in contact with the connecting electrodes 38. The contact pins 39*b* are electrically connected to the circuit board 14 by the coil springs 39*c*.

Figure 8:
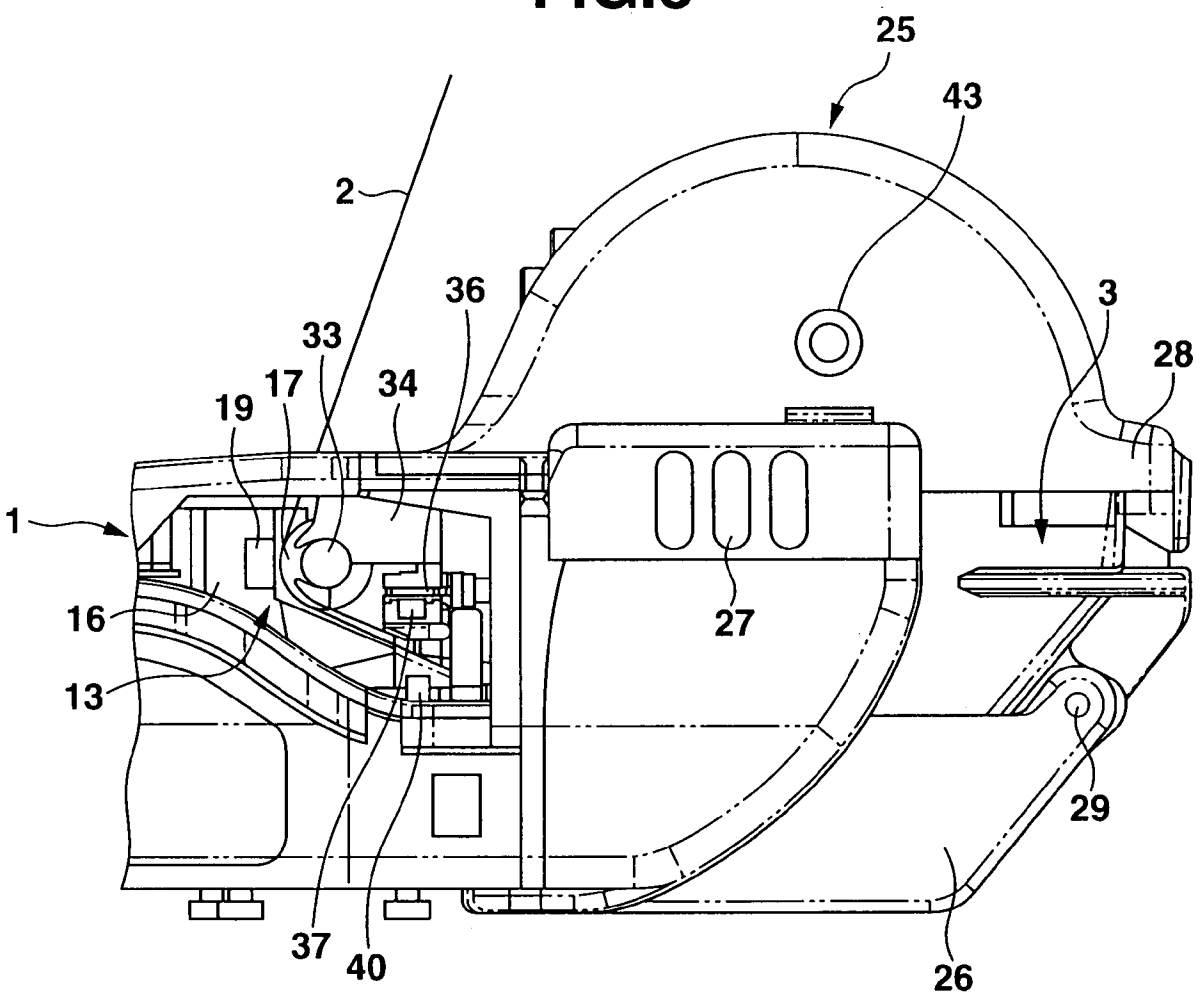
FIG. 8 is a right side view showing the right side of the paper holder and that of a part of the portable information terminal neighboring the paper holder, the neighboring part being broken away.
Figure 9:
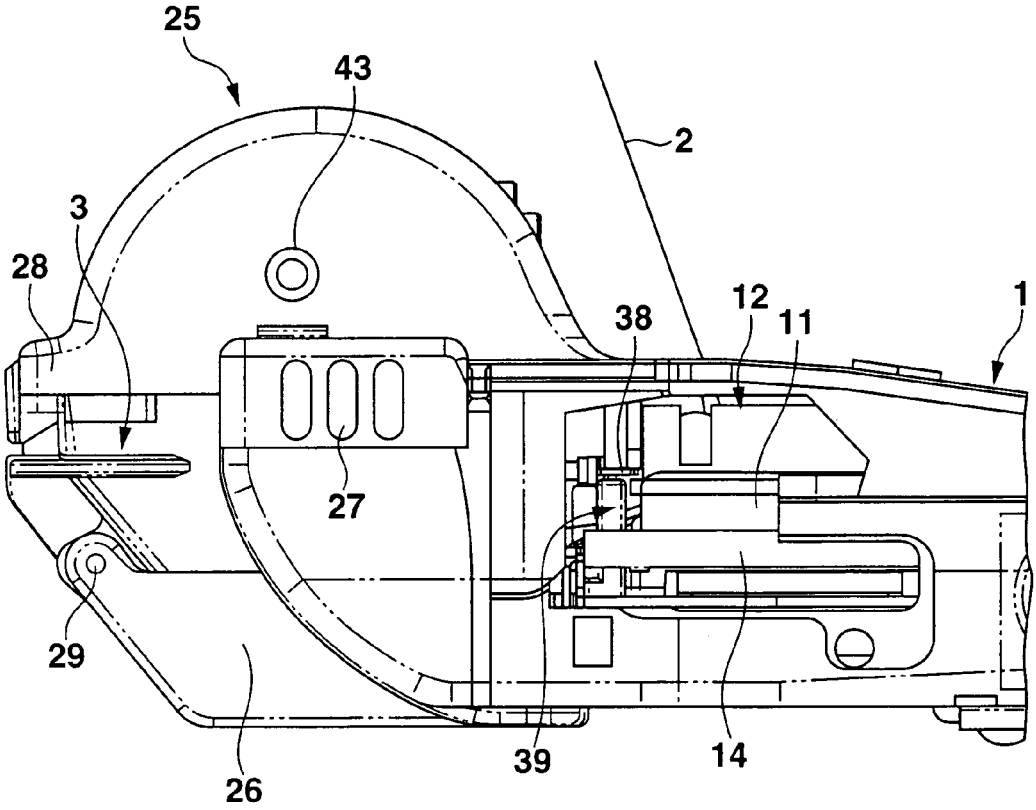
FIG. 9 is a left side view showing the left side of the paper holder and that of the neighboring part of the portable information terminal with the neighboring part being broken away.

In this embodiment, as shown in FIG. 8, a second optical sensor 40 for detecting existence of the recording paper 2 is provided under the first optical sensor 37 in the main body case 1. The second optical sensor 40 is provided on the circuit board 14 in the main body case 1 to correspond to a through hole 16*a* formed in the bottom of the paper guide concave 18 of the unit main body 16 of the printer unit 13. Like the first optical sensor 37, the second optical sensor 40 includes a light-emitting element and a light-receiving element. The second optical sensor 40 applies the light emitted from the light-emitting element through the through hole 16*a* at the bottom of the paper guide concave 18 of the unit main body 16 to the front surface (the surface facing the printing head 19) of the recording paper 2 fed from the paper holder 3 to the paper guide concave 18, and receives the reflected light from the front surface of the recording paper 2 by the light-receiving element, thereby detecting existence of the recording paper 2.

The holder cover 25 has further a water-drop proof cover 41 which is attached to the holder cover 25 by a pair of cover arms 42 to be rotational between a closed position at which the water-drop proof cover 41 covers the paper discharge port 32 of the flange 31 of the holder cover 25 and an open position at which the water-drop proof cover 41 is removed from the paper discharge port 32 of the flange 31 of the holder cover 25. More specifically, the extended end portions of the paired cover arms 42 of the water-drop proof cover 41 are rotatably attached to rotation center shafts 43 provided on both side surfaces of the holder cover 25. Therefore, the water-drop proof cover 41 is rotational between the closed position and the open position along the semi-cylindrical circumferential surface of the holder cover 25 around the rotation center shafts 43. As shown in FIGS. 2 and 7, a cushion member 44 for tightly closing the paper discharge port 32 is provided on the lower surface of the water-drop proof cover 41.

Further, as shown in FIGS. 2 and 7, knobs 45 are provided on both side surfaces of the water-drop proof cover 41. Engaging projections 47 are provided on the knobs 45 to be engaged with engaged indents 46 provided on the both side surfaces of the main body case 1 when the water-drop proof cover 41 is positioned at the closed position. When the water-drop proof cover 41 is positioned at the closed position as shown in FIG. 1 and covers the paper discharge port 32 formed in the flange 31 of the holder cover 25, the engaging projections 47 of the paired knobs 45 engage with the engaged indents 46 on both sides of the main body case 1 so that the cushion member 44 is pressed onto the flange 31 of the holder cover 25 to tightly close the paper discharge port 32. As well shown in FIG. 5, a cutter 48 for cutting the recording paper 2 is provided in the main body case 1 to correspond to the paper discharge port 32 formed in the flange 31 of the holder cover 25.

Figure 11:
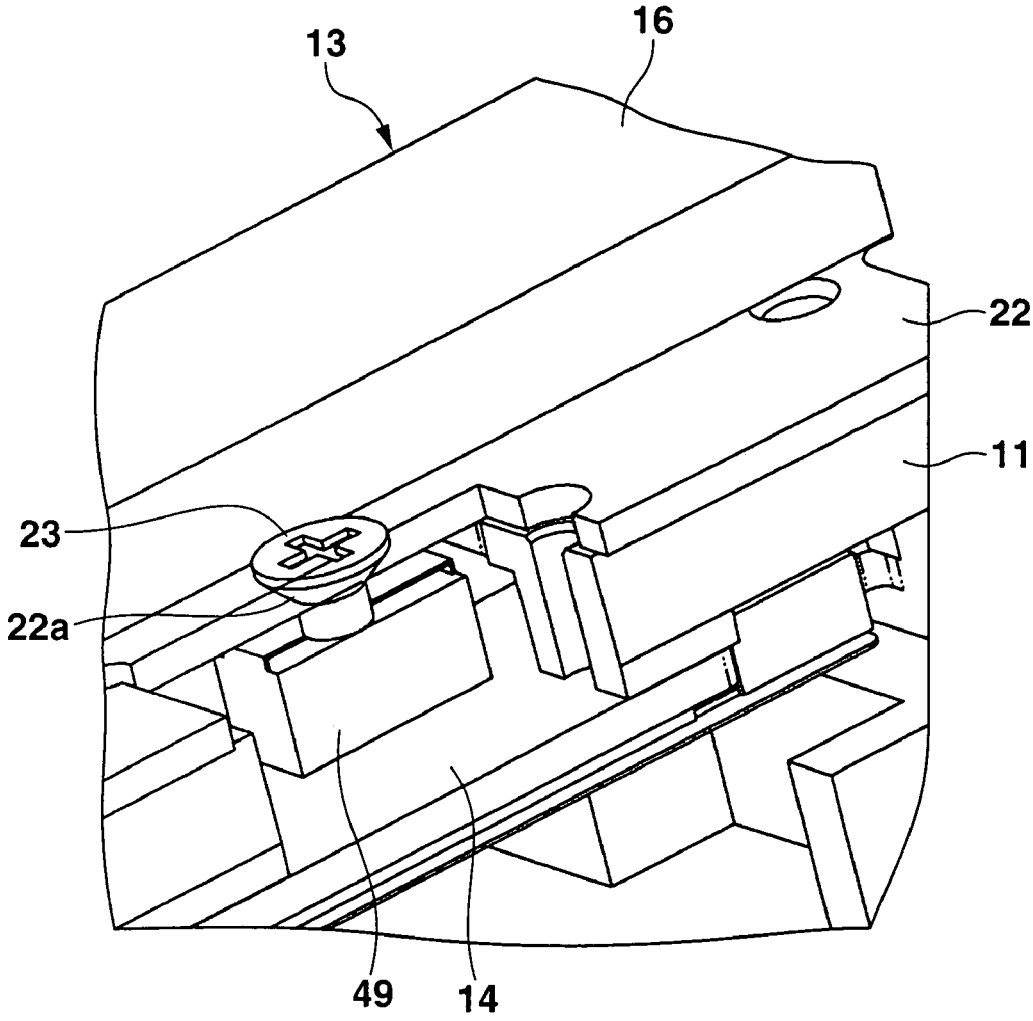
FIG. 11 is an enlarged view of a part indicated by "A" in FIG. 3.

The metallic reinforcing plate 22 of the printer unit 13 is electrically connected to the ground of the circuit board 14 in the main body case 1. Thus, the static electricity charged in the reinforcing plate 22 is earthed through the ground of the circuit board 14. The reinforcing plate 22 is electrically insulated in its whole surface by a rustproof process. However, as shown in FIG. 11, the metallic material of the reinforcing plate 22 is exposed in screw holes 22*a* into which the metallic fixing screws 23 for fixing the reinforcing plate 22 to the inner case 11 are screwed. Therefore, when the fixing screws 23 are screwed into the screw holes 22*a* of the reinforcing plate 22 and the ends of the fixing screws 23 are in contact with a spring-urged contact member 49 provided on the circuit board 14 and electrically connected to the ground of the circuit board 14, the reinforcing plate 22 can be electrically connected to the ground of the circuit board 14.

Now, a preparation procedure for using of the above-mentioned portable information terminal will be described.

At first, a roll of recording paper 2 is loaded in the paper holder 3, and the recording paper 2 is lead into the paper guide concave 18 of the main body case 1. In this time, the holder cover 25 is rotated upward from the closed position to the open position with the holder arm 28 of the distal end portion of the holder cover 25 being rotated around the hinge projection at the distal end of the paper holder 3, as shown in FIG. 6. Then, the roll of recording paper 2 is loaded in the paper holder 3 and the leading end of the recording paper 2 pulled out from the roll of the recording paper 2 is placed into the paper guide concave 18 of the printer unit 13 of the main body case 1.

Next, the holder cover 25 is rotated from the open position to the closed position. In this time, the platen roller 17 provided on the flange 31 of the holder cover 25 is inserted into the paper guide concave 18 of the unit main body 16 of the printer unit 13 through the printer exposing opening 24 of the main body case 1, and the flange 31 of the holder cover 25 covers the printer discharge opening 24.

While the holder cover 25 is rotated from the open position to the closed position, the paired rotation center shafts 33 of the platen roller 17 supported by the holder cover 25 are inserted into and guided by the paired guides 21 on the both sides of the surface of the paper guide concave 18 of the unit main body 16 of the printer unit 13, thereby the platen roller 17 comes close to and faces the printing head 19 of the printer unit 13 in the paper guide concave 18, and the follower gear 35 provided on one of the rotation center shafts 33 engages with the driving gear (not shown) provided in the main body case 1. In this time, the first optical sensor 37 that is provided close to the platen roller 17 on the holder cover 25 is positioned to close to the back surface of the recording paper 2 pulled out from the paper holder 3 and immediately before inserted into the clearance between the platen roller 17 and the printing head 19 in the paper guide concave 18. At the same time, the connecting electrodes 38 of the sensor board 36 of the holder cover 25 are pressed on and electrically connected with the contact pins 39*b* of the connecting terminal portion 39 in the main body case 1 against the urging forces of the coil springs 39*c*.

Next, the paired lock members 27 on the both side surfaces of the main body 1 are slid to engage them with the engaging projections 30 on the both side surfaces of the holder cover 25. Then, the water-drop proof cover 41 is positioned to the closed position.

Next, the communication card (not shown) is inserted into the card holder 15 in the main body case 1. In this time, the card cover 26 is rotated downward around the hinge shaft 29 at the distal end portion of the paper holder 3 to expose the card insertion slot shown in FIG. 5. And, the communication card is inserted into the card insertion slot of the card holder 15, and the inserted communication card is electrically connected to the card connector (not shown) in the card holder 15. In this state, the communication part of the communication card is projected out from the card insertion slot of the main body case 1, and the projected communication part is positioned in the lower side of the paper holder 3. Then, the card cover 26 is rotated to its closed position to cover the projected communication part of the communication card together with the lower surface of the paper holder 3. The card cover 26 positioned at the closed position is fixed to the paper holder 3 by a screw (not shown).

This completes the preparation procedure for using the portable information terminal.

In order to print information on the recording paper 2 by the portable information terminal, at first the water-drop proof cover 41 is rotated upward from the closed position to the open position so that the engaging projections 47 of the paired knobs 44 provided on the both side surfaces of the water-drop proof cover 41 are disengaged from the engaged concaves 46 of the main body case 1. Then, as shown in FIG. 2, the water-drop proof cover 41 rotated upward as described above around the paired supporting shafts 43 of the holder cover 25 opens the paper discharge port 32.

Then, the user inputs information in the portable information terminal by operating the key input unit 5 while monitoring the information displayed on the input display unit 12. The user may transfer necessary data from an external apparatus to the portable information terminal by using the communication card and may input the transferred necessary data in the portable information terminal.

Before the printer unit 13 starts printing of information on the recording paper 2, the second optical sensor 40 provided in the printer unit 13 detects the recording paper 2 and the driving gear (not shown) in the main body case 1 is rotated to rotate the follower gear 35 of the platen roller 17 so that the recording paper 2 is fed by the platen roller 17. During this feeding of the recording paper 2, the first optical sensor 37 provided on the holder cover 25 detects the start position mark included in the mark provided on the back surface of the recording paper 2 to position the leading end of the recording paper 2 at the predetermined start position for printing.

Next, while the printing head 19 of the printer unit 13 is heated to print information on the recording paper 2, the platen roller 17 is rotated in accordance with the information printing speed of the printing head 19 on the recording paper 2 and the recording paper 2 is sequentially fed to the clearance between the platen roller 17 and the printing head 19. Thus, the printing head 19 prints the information sequentially on the recording paper 2 fed by the platen roller 17 and the printed recording paper 2 is sequentially discharged upward from the main body case 1 through the paper discharge port 32 of the flange 31 of the holder cover 25.

In this portable information terminal, the platen roller 17 facing the printing head 19 of the printer unit 13 and the first optical sensor 37 located near to the platen roller 17 to detect the recording paper 2 are provided on the holder cover 25 openably attached to the paper holder 3 being adjacent to the printer unit 13 in the main body case 1 and holding a roll of recording paper 2. Therefore, the first optical sensor 37 is moved with the platen roller 17 as the holder cover 25 is opened and closed, and the first optical sensor 37 can be located very near to the moving trace of the platen roller 17.

The first optical sensor 37 can detect the marks provided on the back surface of the recording paper 2. Therefore, the starting position of the recording paper 2 can be exactly found, and the residual amount of the recording paper 2 can be exactly known. This improves the operability of the portable information terminal without increasing its size.

In this embodiment, when the holder cover 25 covers the paper holder 3 and the platen roller 17 faces the printing head 19, that is, when the holder cover 25 is positioned at the closed position, the connecting electrodes 38 provided on the holder cover 25 and electrically connected to the first optical sensor 37 are in contact with and electrically connected to the connecting terminal portion 39 electrically connected to the circuit board 14 in the main body case 1. Therefore, although the first optical sensor 37 is provided on the holder cover 25 being rotational between the open position and the closed position to the paper holder 3, the first optical sensor 37 of the holder cover 25 can be surely electrically connected to the circuit board 14 in the main body case 1. This makes the wiring for electrically connecting the first optical sensor 37 of the holder cover 25 to the circuit board 14 of the main body case 1 can be made simple.

Further, since the first optical sensor 37 and the connecting electrodes 38 are electrically connected to each other on the common sensor board 36, assembling the first optical sensor 37, the connecting electrodes 38 and the wiring thereof with the holder cover 25 are simple and easy, compared with a case that the first optical sensor 37 and the connecting electrodes 38 are separately provided on the holder cover 25 and electrically connected to each other by an independent connecting wires. This increases the productivity of the portable information terminal.

The connecting terminal portion 39 in the main body case 1 has the plural contact pins 39*b* which contact the connecting electrodes 38 of the sensor board 36 provided on the holder cover 25 being rotational between the open position and the closed position when the holder cover is positioned at the closed position, the holding member 39*a* which holds the contact pins 39*b* to allow the movement of each of these contact pins 39*b* between the projecting position and the retracted position, and the coil springs 39*c* which urge the contact pins 39*b* in the direction in which the contact pins 39*b* project outward from the holding member 39*a*. And, the contact pins 39*b* are electrically connected to the circuit board 14 by the coil springs 39*c* corresponding to the contact pins 39*b*.

Therefore, although the connecting electrodes 38 is provided on the holder cover 25 being rotational between the open position and the closed position to the paper holder 3, the contact pins 39*b* are elastically in contact with the connecting electrodes 38 by the urging force of the coil springs 39*c* when the holder cover 25 is positioned at the closed position and the connecting electrodes 38 are in contact with the contact pins 39*b* of the connecting terminal portion 9. This provides the surely electrical connection of the connecting electrodes 38 of the holder cover 25 to the contact pins 39*b* of the connecting terminal portion 39 of the main body case 1.

Further, the metallic reinforcing plate 22 of the unit main body 16 of the printer unit 13 increases the rigidity of the printer unit 13. The static electricity charged in the metallic reinforcing plate 22 is surely transferred to the ground of the circuit board 14 through the metallic fixing screws 23 screwed into the screw holes 22*a* of the reinforcing plate 22 and being in contact with the spring contact member 49 electrically connected to the ground of the circuit board 14.

Although the whole surface of the metallic reinforcing plate 22 is processed by the rustproof processing, the material of the reinforcing plate 22 is exposed when the fixing screws 23 are screwed into the screw holes 22*a*. And, the fixing screws 23 and the reinforcing plate 22 are electrically connected to each other so that the reinforcing plate 22 can be electrically connected to the ground of the circuit board 14 through the fixing screws 22.

Modification of First Embodiment

Figure 12:
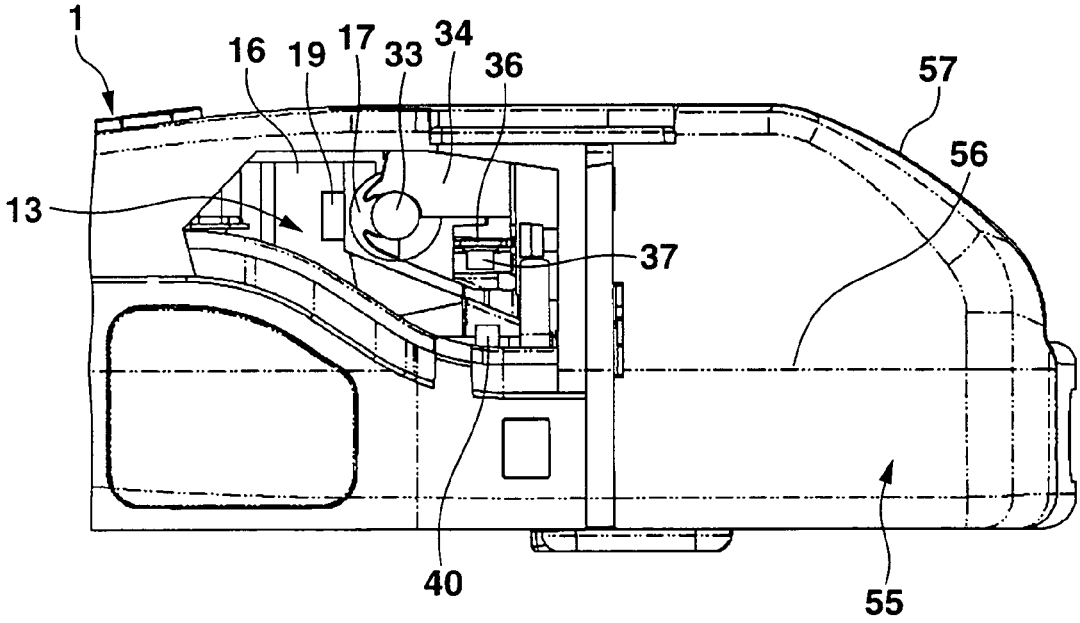
FIG. 12 is a right side view showing the right side of a modified paper holder and the part of the portable information terminal neighboring the modified paper holder, the neighboring part being broken away.
Figure 13:
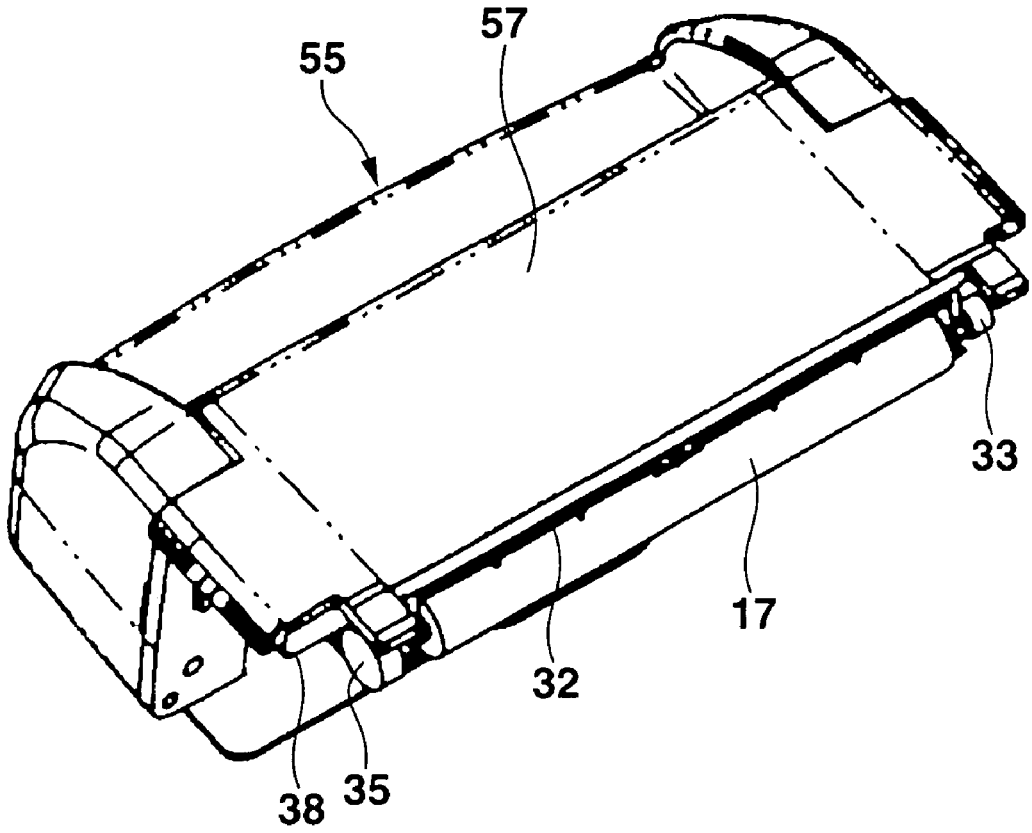
FIG. 13 is a perspective view of the modified paper holder shown in FIG. 12.
Figure 14:
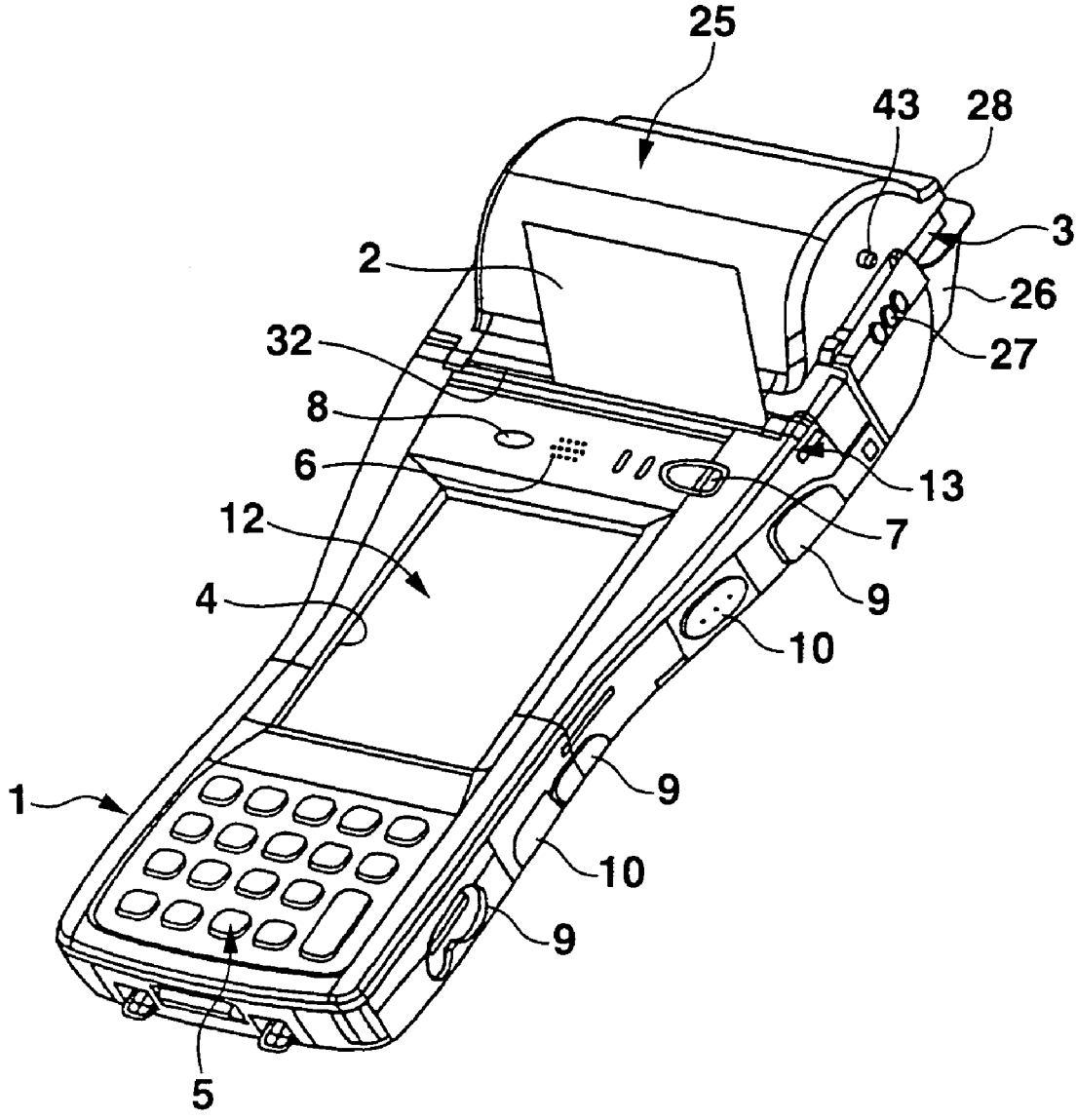
FIG. 14 is a perspective view of a portable information terminal according to a second embodiment of the present invention in a state that information is printed on a recording paper while a paper guide and a water-drop proof cover are removed.

In the above-mentioned embodiment, the paper holder 3 for holding a roll of recording paper 2 is attached to the main body case 1. In the modification shown in FIGS. 12 and 13, instead of the paper holder 3, a paper holder 55 for holding many sheets of recording paper (not shown) may be attached to the main body case 1. The paper holder 55 has a recording paper sheet holding portion 56 for holding stacked many sheets of recording paper, a holder cover 57 being rotational between an open position at which the holder cover 57 does not cover the recording paper sheet holding portion 56 and a closed position at which the holder cover 57 covers the recording paper sheet holding portion 56, and a recording paper feeding mechanism (not shown) for sequentially feeding the recording paper sheets from the recording paper sheet holding portion 56. The holder cover 57 is provided with the platen roller 17 and the sensor board 36, like the holder cover 25 of the first embodiment. In this modification, the sensor board 36 is provided with the first optical sensor 37 and the connecting electrodes 38. When the holder cover 57 is positioned at the closed position while the paper holder 55 is attached to the main body case 1, the connecting electrodes 38 of the holder cover 57 are in contact with the contact pins 39*b* of the connecting terminal portion 39 in the main body case 1 so that the first optical sensor 37 is electrically connected to the circuit board 14 in the main body case 1.

This modified portable information terminal provides the same technical advantages as those provided by the first embodiment.

In the above-mentioned first embodiment and its modification, each of the holder covers 25 and 57 supports the platen roller 17. A plate-like platen may be used instead of the platen roller 17. In this case, it is necessary to provide a paper feed-out mechanism for feeding the recording paper 2 from the roll of recording paper 2 into the clearance between the plate-like platen and the printing head 19, in the paper holder 3 for holding the roll of recording paper 2 in the above-mentioned first embodiment.

Further, in each of the above-mentioned first embodiment and its modification, the portable information terminal is explained as an example of a portable electronic apparatus. But, the portable electronic apparatus according to the invention is not limited to this, and may be, for example, a portable telephone, an electronic dictionary, a PDA (Personal Digital Assistant) and other various electronic apparatus.

Second Embodiment

Now, a portable information terminal according to a second embodiment of the present invention will be described with reference to FIGS. 14-26.

The most elements of the portable information terminal according to the second embodiment are the same as those of the portable information terminal according to the first embodiment described with reference to FIGS. 1-11. Therefore, the elements of the portable information terminal of the second embodiment being the same of those of the portable information terminal of the first embodiment are designated by the reference numerals being the same used to designate the elements of the portable information terminal of the first embodiment corresponding to those of the portable information terminal of the second embodiment. And, detailed explanations about the same elements of the portable information terminal of the second embodiment will be omitted.

Only the difference of the second embodiment from the first embodiment is the structure of a water-drop proof cover 100. The water-drop proof cover 100 of the second embodiment has an upper cover 102 and a lower cover 104.

The upper cover 102 covers the upper surface and upper halves of the both side surfaces of the distal end portion of the main body case 1, the upper surface and both side surfaces of the holder cover 25, and the upper half and upper halves of the both side surfaces of the distal end portion of the paper holder 3. The lower cover 104 covers the lower surface and lower halves of the both side surfaces of the distal end portion of the main body case 1, and the lower half and lower halves of the both side surfaces of the distal end portion of the paper holder 3.

Figure 15:
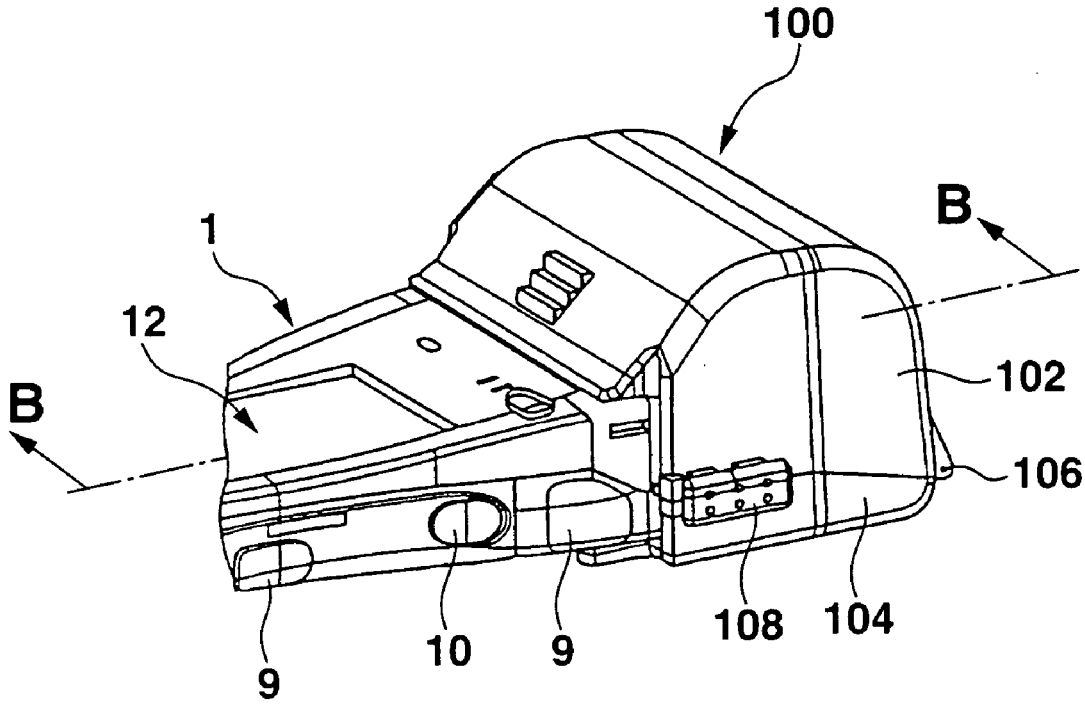
FIG. 15 is a perspective view showing the distal end portion of the portable information terminal shown in FIG. 14 in a state that the paper guide member and the water-drop proof cover are fitted thereon.
Figure 16:
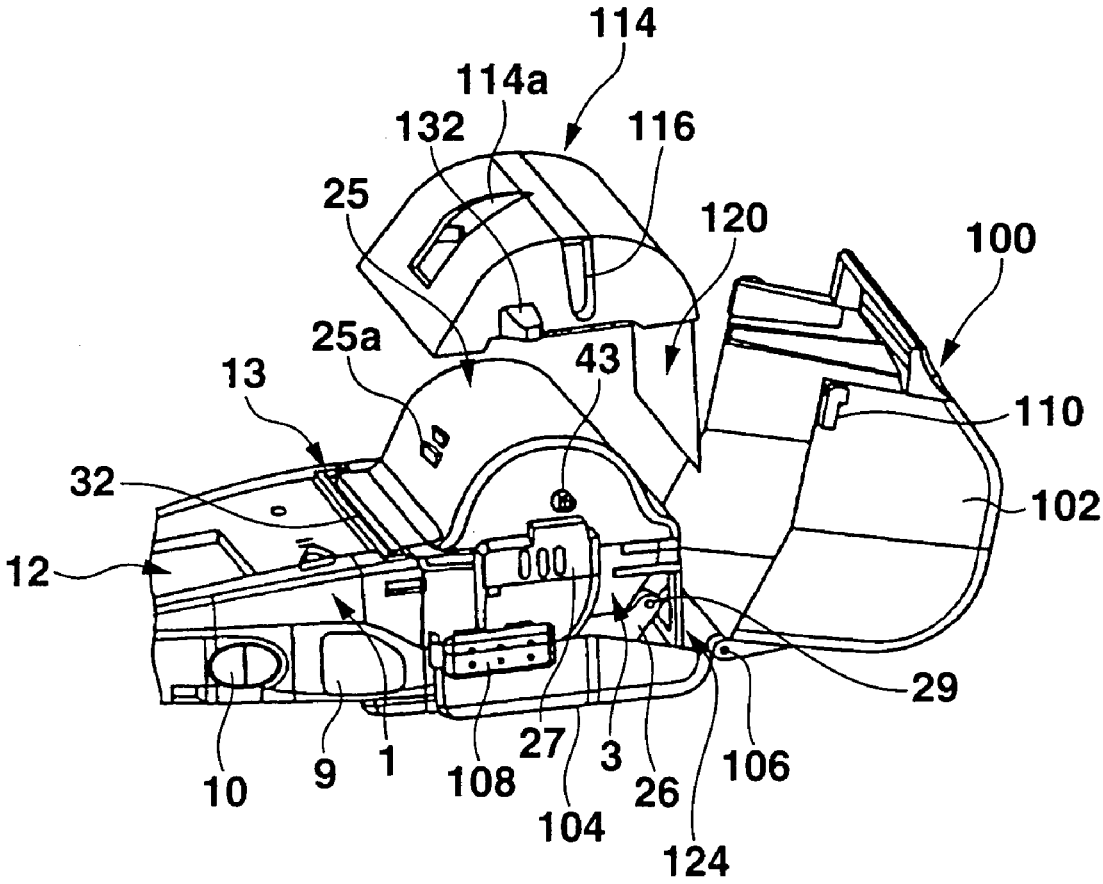
FIG. 16 is a perspective view showing the distal end portion shown in FIG. 15 in a state that an upper portion of the water-drop proof cover is opened and an upper paper guide member is disassembled.

The upper cover 102 and the lower cover 104 are rotatably connected by a cover hinge 106 located in the outside of the distal end portion of the paper holder 3. As shown in FIGS. 15 and 16, the water-drop proof cover 100 further has cover lock members 108 provided slidably on the both side surfaces of the lower cover 104, and engaging projections 110 provided on the both side surfaces of the upper cover 102. When the cover lock members 108 of the lower cover 104 are engaged with the engaging projections 110 of the upper cover 104 while the upper cover 102 are closed on the lower cover 104, the upper cover 102 is locked to the lower cover 104.

Figure 18:
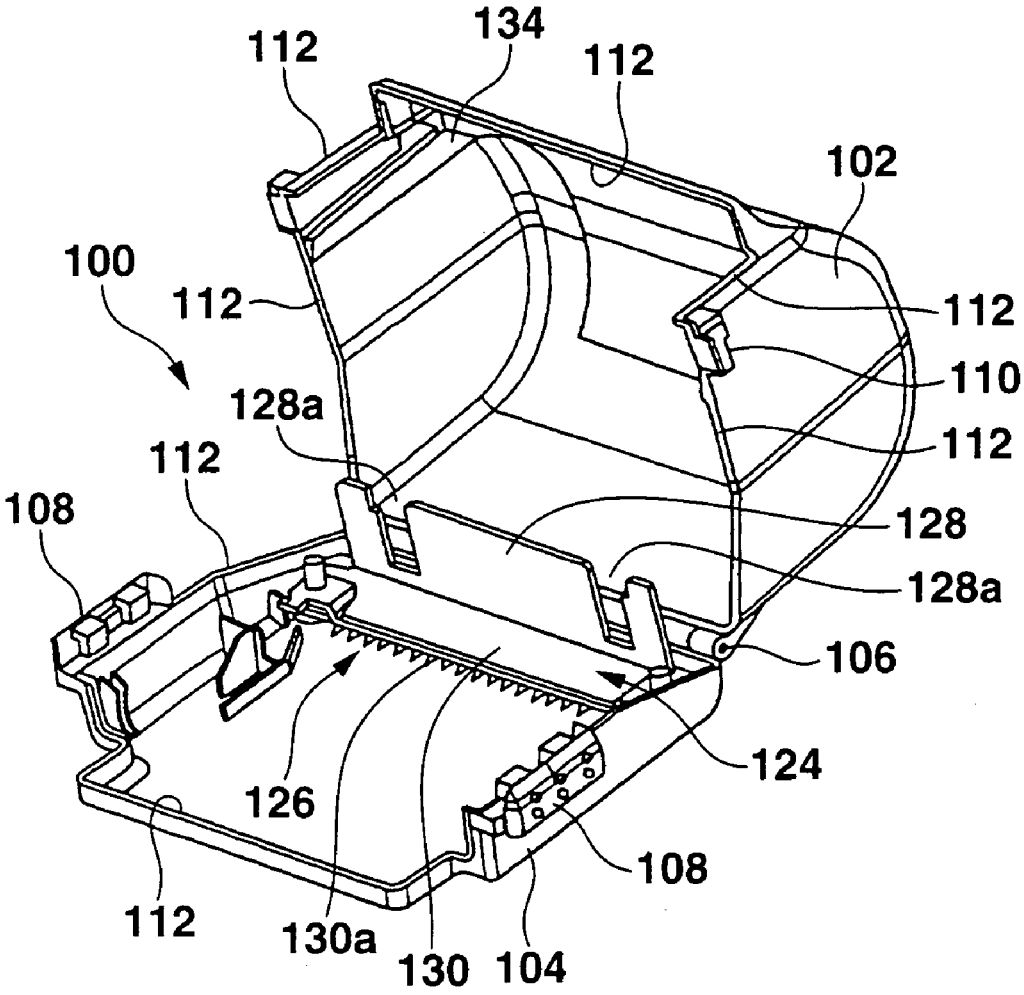
FIG. 18 is a perspective view of the water-drop proof cover shown in FIG. 16 in a state that the upper portion of the water-drop proof cover is opened.
Figure 19:
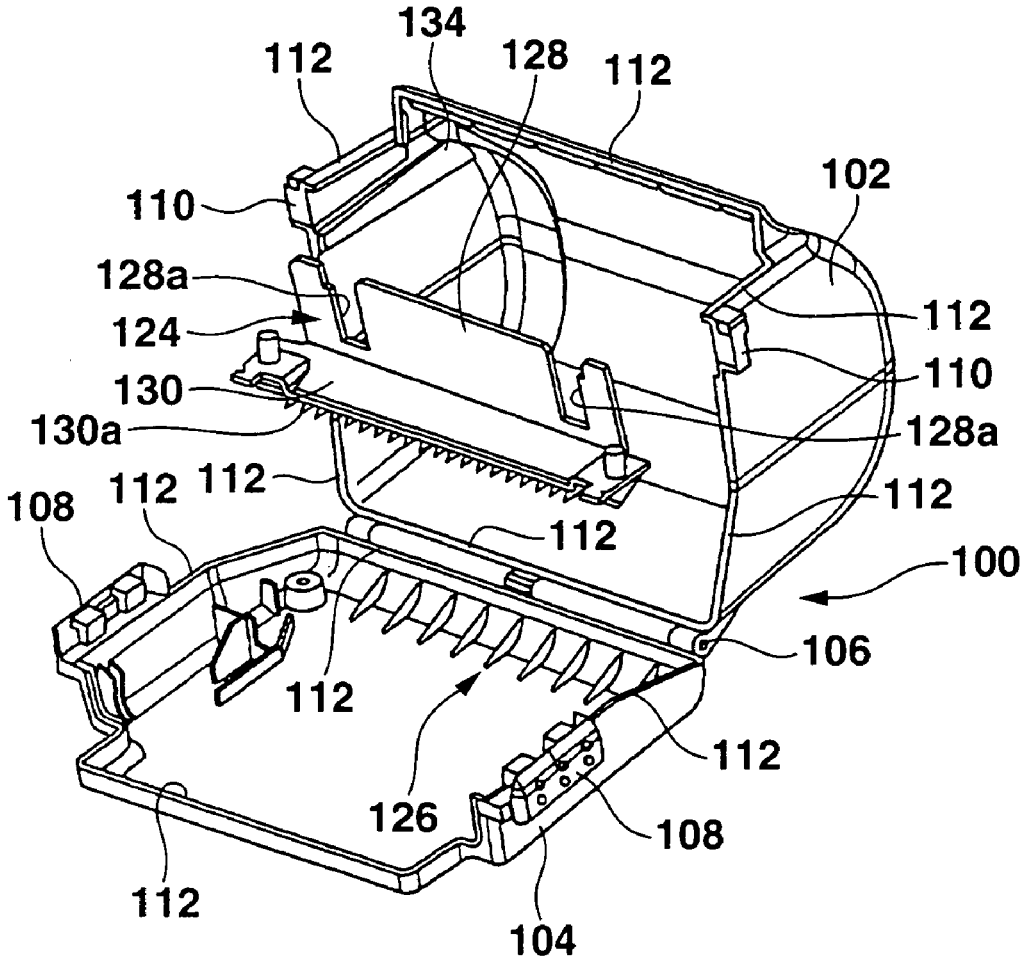
FIG. 19 is a perspective view of the water-drop proof cover shown in FIG. 18 in a state that the upper portion of the water-drop proof cover is opened and a lower paper guide member is disassembled.

Waterproof seal members 112 made of rubber or the like are provided at the edges of the upper cover 102 and lower cover 104, as shown in FIGS. 18 and 19. When the water-drop proof cover 100 is set at a predetermined position at which the water-drop proof cover 100 covers the distal end portion of the main body case 1, the paper holder 3 and the holder cover 25 while the upper cover 102 and the lower cover 104 are closed, the waterproof seal members 112 are intimately in contact with the outer surface of the distal end portion of the main body case 1 and also intimately in contact with each other on the parts of the edges of the upper cover 102 and lower cover 104 facing each other.

The water-drop proof cover 100 further includes an upper paper guide member 114 for guiding the printed recording paper 2 discharged out from the paper discharge port 32 of the man body case 1 along the inner circumferential surface of the upper cover 102 of the water-drop proof cover 100. The upper paper guide member 114 has a semi-cylindrical shape with the convex side being positioned upward, and is provided with fitting holes 116 on the right and left side surfaces. The paper guide member 114 is attached on the upper surface of the holder cover 25 while the rotation center shafts 43 provided on the both side surfaces of the holder cover 25 are inserted into the fitting holes 116.

Figure 17:
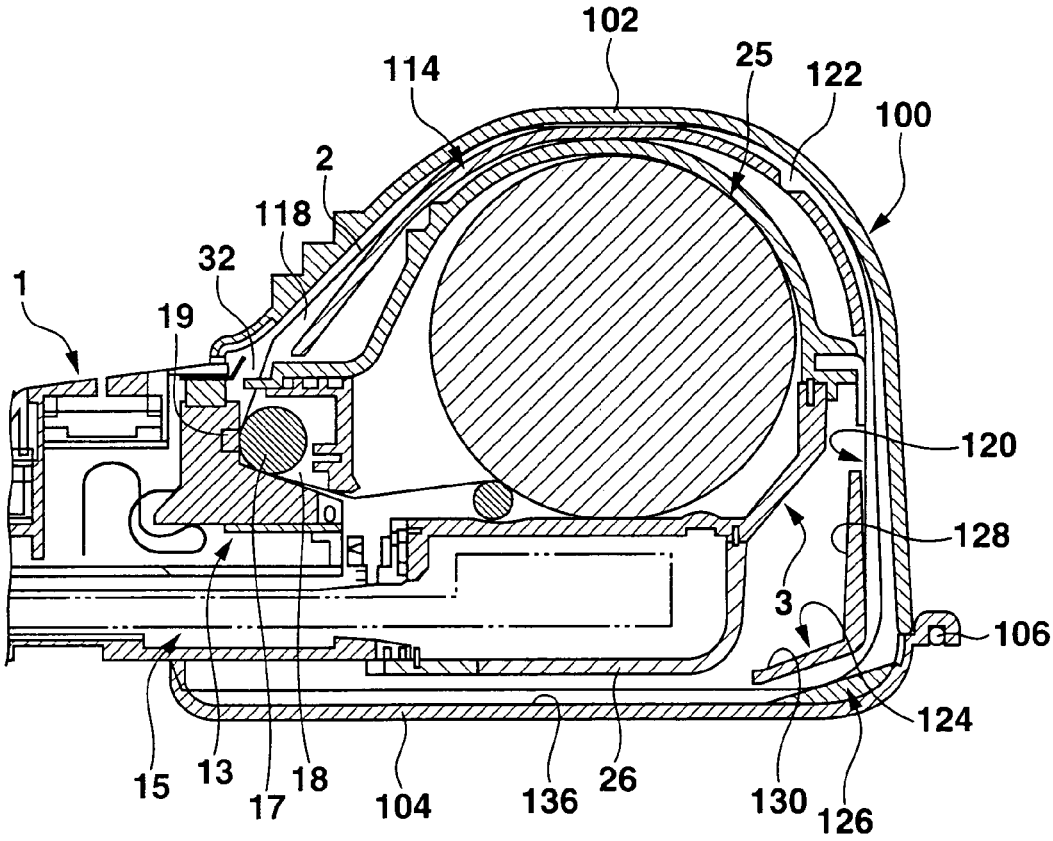
FIG. 17 is a sectional view of the distal end portion taken along a B-B line shown in FIG. 15.

As shown in FIG. 17, the upper paper guide member 114 attached on the upper surface of the holder cover 25 forms a paper guide path 118, which guides the printed recording paper 2 discharged out from the paper discharge port 32 of the main body case 1, between the upper circumferential surface of the upper paper guide member 114 and the inner circumferential surface of the upper cover 102 positioned at the closed position at which the upper cover 102 covers the upper surface of the holder cover 25. As shown in FIG. 16, an opening 114*a* is formed in a part of the upper wall of the upper paper guide member 114 being close to the main body case 1, and the opening 114*a* exposes a group of projections and indentations 25*a* provided on the upper surface of the holder cover 25 to operate the rotation of the holder cover 25. The group of projections and indentations 25*a* located in the opening 114*a* of the upper paper guide member 114 does not project outward from the upper circumferential surface of the upper paper guide member 114. The opening 114*a* is formed to have an elongated triangular shape which is wide at one end close to the main body case 1 and narrowed as separating from the end. This shape of the opening 114*a* prevents the leading end of the printed recording paper 2 discharged out from the paper discharge port 32 from being caught by the opening 114*a*, and guides the discharged printed recording paper 2 smoothly.

Figure 20:
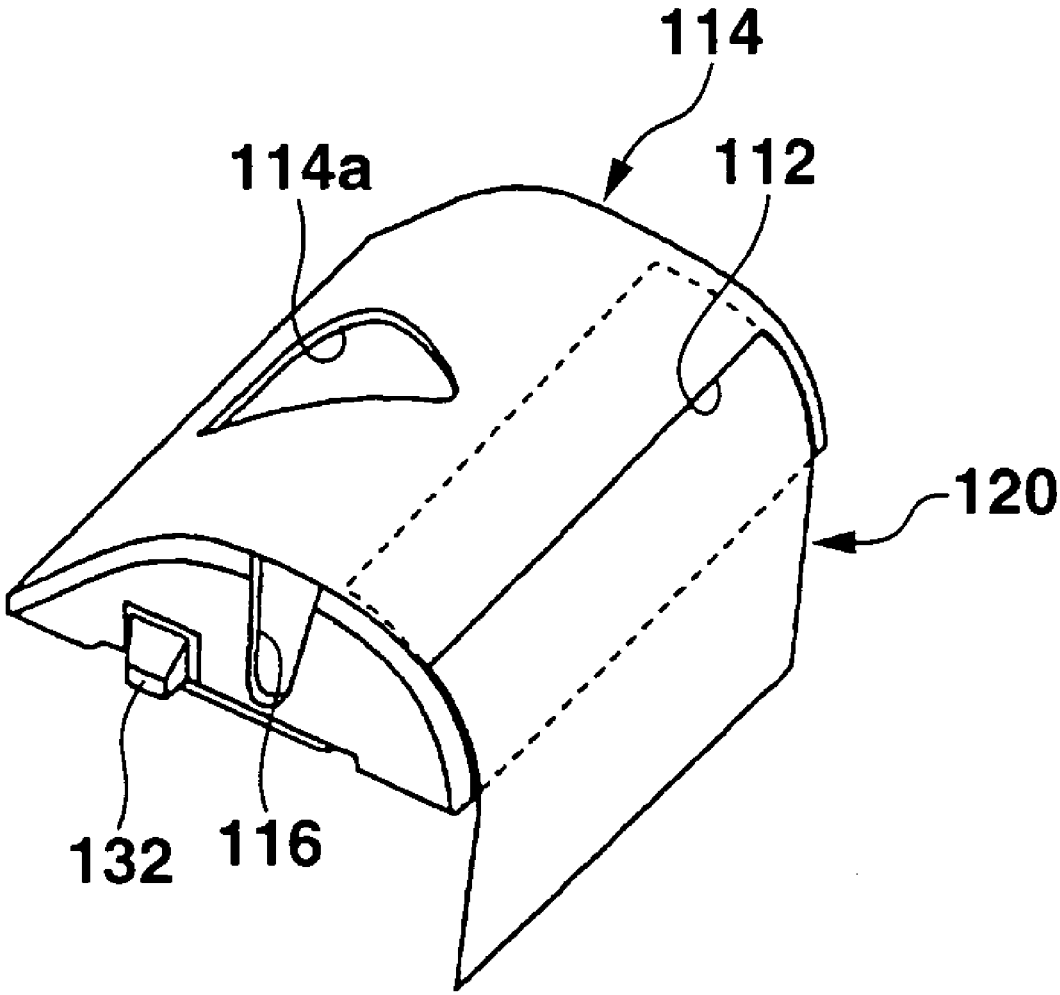
FIG. 20 is a perspective view showing the upper paper guide member shown in FIG. 16.

A guide sheet 120 is hung down from the part of the upper surface of the upper paper guide 114 corresponding to the distal end portion of the holder cover 25, as shown in FIGS. 17 and 20. The guide sheet 120 is made of synthetic resin such as PET (Polyethylene terephthalate), and has the upper end portion inserted into a slit 122 formed in the distal end portion of the upper surface of the upper paper guide 114 to extend along the width direction of the distal end portion. The inserted upper end portion of the guide sheet 120 is fixed by fixing means such as adhesive to the inner circumferential surface of the upper paper guide member 114. This prevents the leading end of the printed recording paper 2 moved in the paper guide path 118 between the upper circumferential surface of the upper guide member 114 and the inner circumferential surface of the upper cover 102 of the water-drop proof cover 100, from being caught by the upper end portion of the guide sheet 120.

The guide sheet 120 is further fixed by non-projecting fixing means such as adhesive to the part of the upper circumferential surface of the upper guide member 114 located between the slit 122 and the end of the distal end portion. The lower end of the guide sheet 120 hanging down from the distal end portion of the upper circumferential surface of the paper guide member 114 is located rearward (the right side in FIG. 17) of a lower paper guide member 124 provided at the distal end portion of the internal circumferential surface of the lower cover 104, as shown in FIG. 17. Thus, as shown in FIG. 17, the lower end of the guide sheet 120 prevents the leading end of the printed recording paper 2 moved downward in the paper guide path 118 between the guide sheet 120 and the inner circumferential surface of the upper cover 102 of the water-drop proof cover 100 from being caught by the lower guide member 124.

Only both of the right and left side end portions of the lower paper guide member 124 are fixed to the distal end portion of the inner bottom surface of the lower cover 104 of the water-drop proof cover 100, and the middle portion of the lower paper guide member 124 is separated from the inner bottom surface of the lower cover 104.

Plural paper guide ribs 126 are provided at the corner of the distal end portion of the inner bottom surface of the lower cover 104 so that the paper guide ribs 126 are arranged with equal intervals in the right and left directions on the corner. Each of these paper guide ribs 126 is formed to have a substantially crescent shape, and smoothly bends the recording paper 2 moved downward in the paper guide path 118 between the guide sheet 120 and the inner circumferential surface of the upper cover 102 of the water-drop proof cover 100 to move the recording paper 2 along the inner bottom surface of the lower cover 104.

As shown in FIGS. 17-19, the lower paper guide member 124 includes an upwardly extending guide piece 128 and a lower guide piece 130. The upwardly extending guide piece 128 covers the rotation center axis 29 provided at the distal end portion of the paper holder 3 for the card cover 26 and prevents the leading end of the recording paper 2 moving down in the paper guide path 118 between the guide sheet 120 and the inner circumferential surface of the upper cover 102 from being caught by the rotation center axis 29. The lower guide piece 130 prevents the leading end of the recording paper 2 bent and guided by the paper guide ribs 126 at the corner of the distal end portion of the inner bottom surface of the lower cover 104 along the inner bottom surface of the lower cover 104 from being caught by the card cover 26 for the card insertion slot of the card holder 15 in the main body case 1.

As shown in FIG. 17, the upwardly extending guide piece 128 of the lower paper guide member 124 is located in the inside (the left side in FIG. 17) of the guide sheet 120 of the upper paper guide member 114. As shown in FIG. 18, notches 128*a* are formed in the upwardly extending guide piece 128 to prevent the holder arms 28 of the holder cover 25 from striking the upwardly extending guide piece 128 and to allow the holder cover 25 to be fully opened when the holder cover 25 is rotated from the closed position to the opened position around the hinge projection at the end of the distal end portion of the paper holder 3. The lower surface of the lower guide piece 130 is inclined to extend along the upper end surfaces of the paper guide ribs 126 each having the crescent shape, and has a guide piece 130*a* of a saw-blade shape at its front end (the left end in each of FIGS. 18 and 19). The saw-blade shaped guide piece 130*a* is made of synthetic resin such as PET like the guide sheet 120, and the projecting points of the saw-blade shaped guide piece 130*a* decrease the area to be in contact with the recording paper 2, and reduce the friction resistance generated in the recording paper 2 sliding on the saw-blade shaped guide piece 130*a*.

Figure 21:
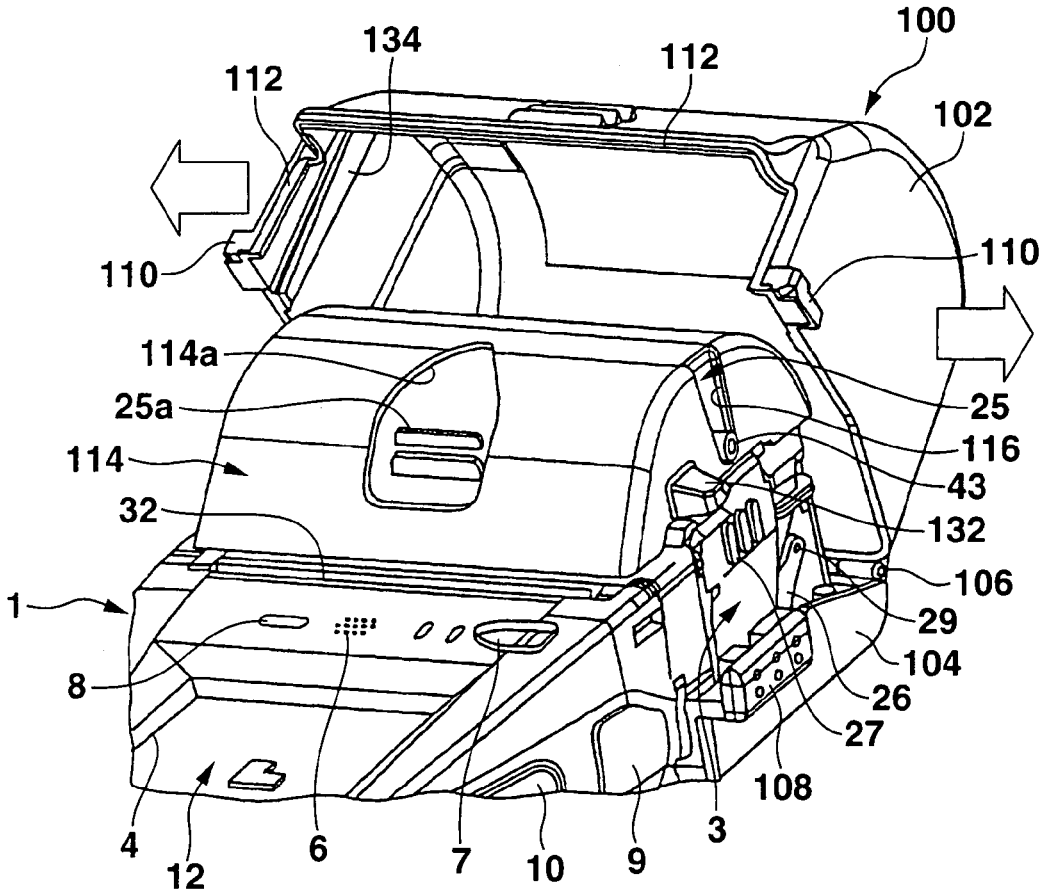
FIG. 21 is a perspective view of the distal end portion shown in FIG. 15 in a state that the upper portion of the water-drop proof cover is opened.

As shown in FIGS. 20 and 21, projections 132 projecting sideways are provided in front of the fitting holes 116 on the both side surfaces of the upper paper guide member 114. As shown in FIGS. 18, 19, and 21-26, upwardly extending cover guide ribs 134 are provided on the front end portions of both of the inner side surfaces of the upper cover 102 of the water-drop proof cover 100.

The upwardly extending cover guide ribs 134 are in contact with the projections 132 on the both side surfaces of the upper paper guide member 114 while the upper cover 102 is rotated between the open position and the closed position and the free end of the upper cover 102 is moved along the both side surfaces of the distal end portion of the main body case 1, so that the free end of the upper cover 102 is elastically widened to prevent the water proof seals 112 provided on the free end of the upper cover 102 from sliding on the both side surfaces of the distal end portion of the main body case 1 and to prevent them from wearing by the sliding contact with both side surfaces of the distal end portion of the main body case 1. Thus, the life of the water proof seals 112 is prolonged.

Figure 25:
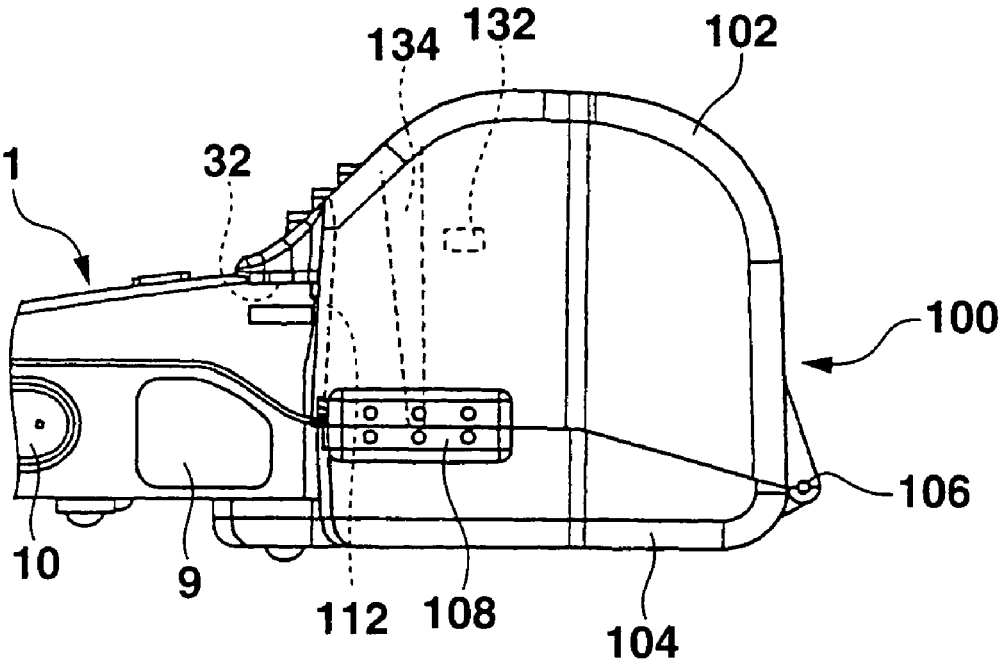
FIG. 25 is a side view of the distal end portion shown in FIG. 15 in a state that the upper portion is completely closed after the cover guide ribs of the upper portion are slid on and separated from the projections of the paper holder cover.
Figure 26:
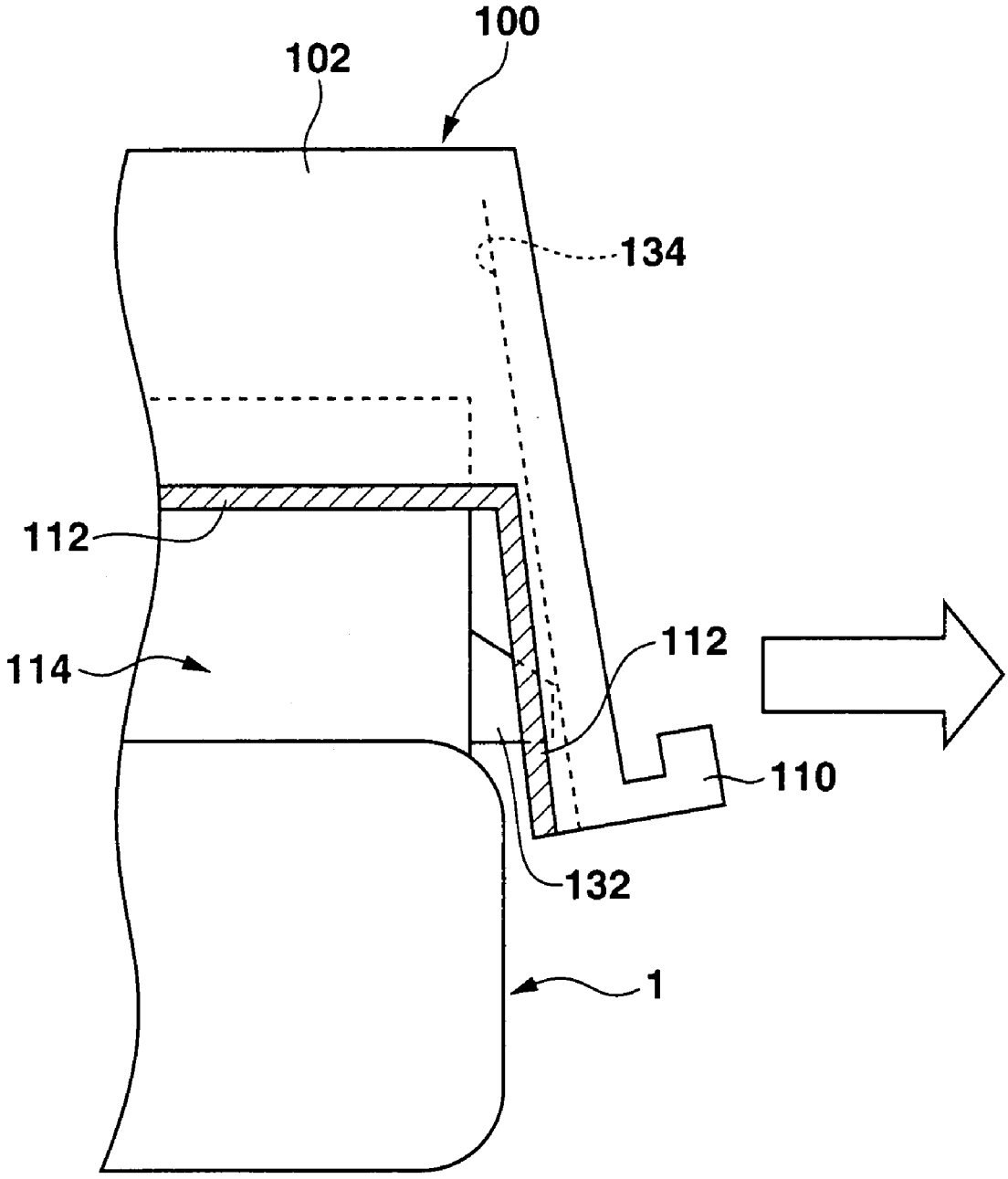
FIG. 26 is an enlarged partial front view showing a state that the cover guide ribs of the upper portion of the water-drop proof cover is slid on the projections of the paper holder cover and the upper portion is elastically broadened as shown in FIG. 24.

The upwardly extending cover guide ribs 134 of the upper cover 102 are left from the projections 132 on the both side surfaces of the upper paper guide member 114 when the upper cover 102 is positioned at the closed position on the lower cover 104 as shown in FIG. 25, so that the free end of the upper cover 102 is not elastically widened by the projections 132 of the upper paper guide member 114 and elastically returned to its original shape. As a result of this, the waterproof seal members 112 provided on the free end of the upper cover 104 are intimately in contact with the both side surfaces of the distal end portion of the main body case 1. Also, at the closed position of the upper cover 104, the waterproof seal members 112 provided on the free end of the upper cover 104 are intimately in contact with the upper surface of the distal end portion of the main body case 1 to tightly seal the recording paper discharge port 32 in the upper surface of the distal end portion of the main body case 1.

Now, a preparation procedure for using the portable information terminal according to the second embodiment of the invention will be described with reference to FIGS. 14 to 26.

When the portable information terminal according to the second embodiment is used indoors, the communication card is inserted into the card holder of the main body case 1 and a roll of recording paper 2 is loaded in the paper holder 3 provided at the distal end portion of the main body case 1. In this time, the holder cover 25 of the paper holder 1 is rotated upward from the closed position to the open position with the holder arm 28 of the distal end portion of the holder cover 25 being rotated around the hinge projection of the distal end of the main body case 1, and the roll of recording paper 2 is loaded in the opened paper holder 3.

Next, the leading end of the recording paper 2 is pulled out from the roll of the recording paper 2 and placed in the paper guide concave 18 of the printer unit 13, and the holder cover 25 is rotated to the closed position. In this time, like in the portable information terminal according to the first embodiment, the leading end of the recording paper 2 fed out from the roll of the recording paper 2 in the paper holder 3 is sandwiched by the printing head 19 and the platen roller 17 in the paper guide concave 18, as shown in FIG. 17. And, the preparation procedure for using the portable information terminal is finished.

In this case, it is unnecessary to use the water-drop proof cover 100.

When the portable information terminal according to the second embodiment is used outdoors, the water-drop proof cover 100 which covers the distal end portion of the main body case 1, the paper holder 3 and the holder cover 25 can be used as shown in FIG. 15. In this time, after the preparation procedure for using the portable information terminal is finished as described above, at first the upper cover 102 of the water-drop proof cover 100 is opened, and then the lower cover 104 is applied to the distal end portion of the main body case 1 and the paper holder 3 from their lower side to cover the lower half of the distal end portion of the main body case 1 and that of the paper holder 3, as shown in FIG. 16.

Then, the upper paper guide member 114 is attached on the holder cover 25 of the paper holder 3, as shown in FIG. 21. In this time, as shown in FIGS. 17 and 22, the guide sheet 120 hanging down from the rear end or the distal end of the upper paper guide member 114 covers the rear surface (the right side surface in FIG. 17) of the upwardly extending guide portion 128 of the lower paper guide member 124 provided on the distal end portion of the inner bottom surface of the lower cover 104.

Figure 22:
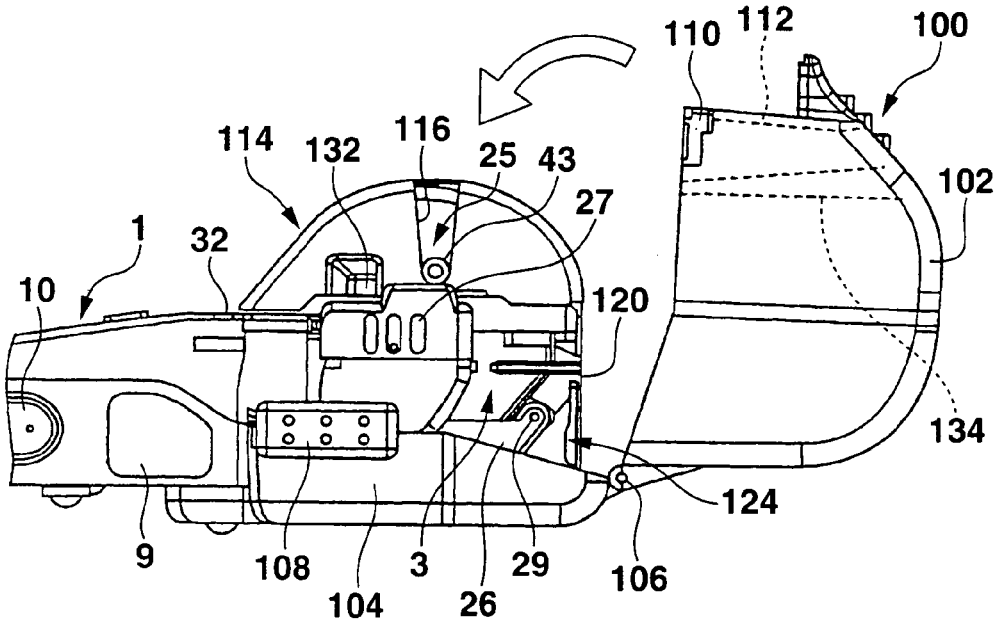
FIG. 22 is a side view of the distal end portion shown in FIG. 21.
Figure 23:
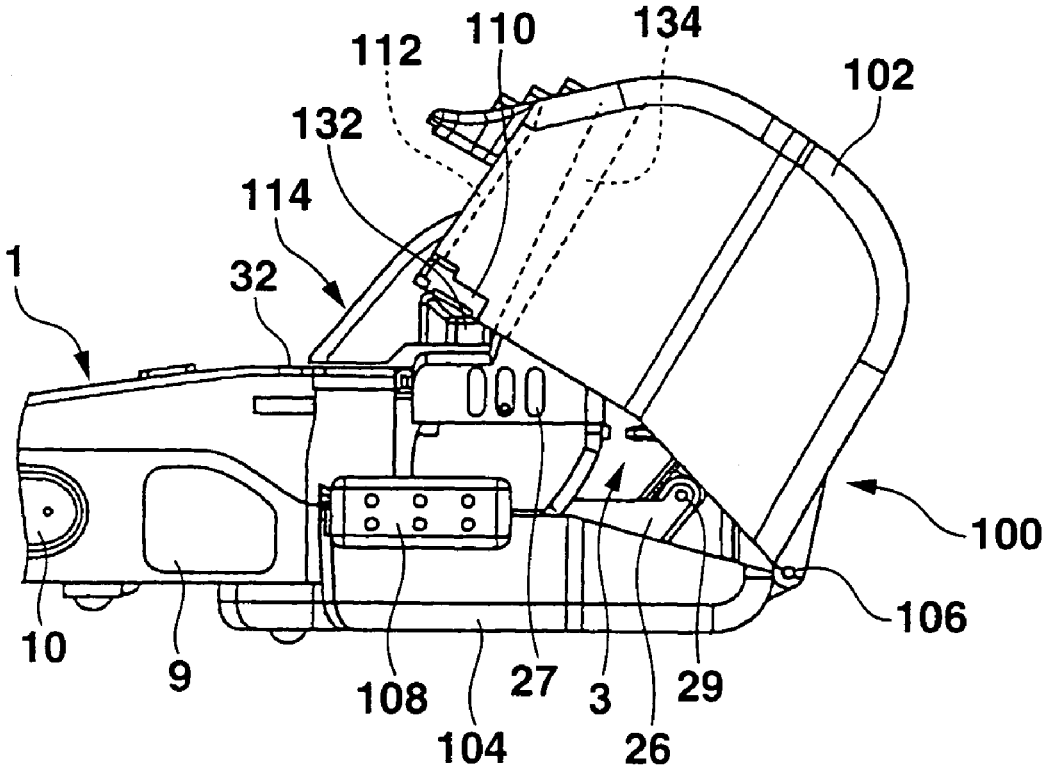
FIG. 23 is a side view of the distal end portion shown in FIG. 15 in a state that the upper portion of the water-drop proof cover is on a way while the upper portion is rotated from the open position to the closed position.
Figure 24:
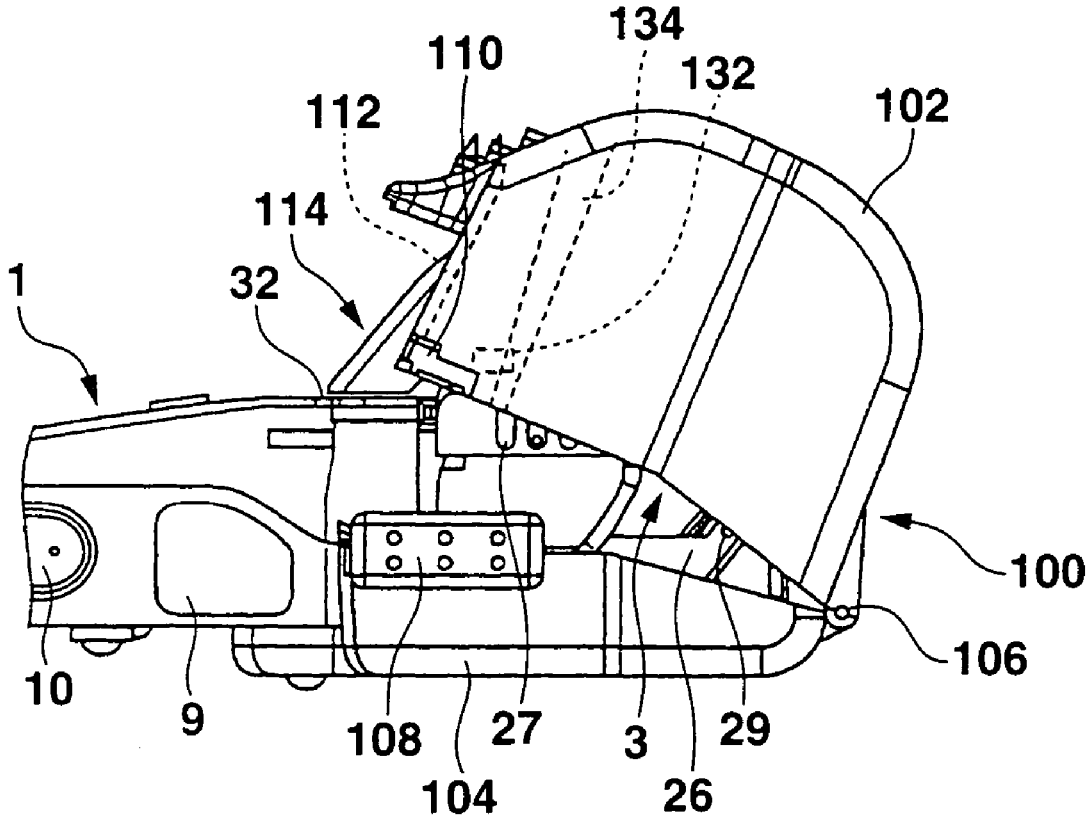
FIG. 24 is a side view of the distal end portion shown in FIG. 15 in a state that the upper portion of the water-drop proof cover is on the way while the upper portion is rotated from the open position to the closed position and the upper portion is elastically broadened by sliding of cover guide ribs of the upper portion on projections of the paper holder cover.

Then, the upper cover 102 of the water-drop proof cover 100 is rotated from the open position to the closed position as shown in FIG. 22, so that the upper cover 27 covers the upper half of the distal end portion of the main body case 1, the upper half of the paper holder 3, the upper half of the holder cover 25, and the upper paper guide member 114 on the holder cover 25. And, the engaging projections 110 of the upper cover 102 are locked by the cover lock members 108 on the both side surfaces of the lower cover 104.

Thus, as shown in FIG. 17, the front end portion or the free end portion of the upper cover 102 covers the paper discharge port 32 in the distal end portion of the main body case 1, and at the same time, the paper guide path 118 for guiding the printed recording paper 2 discharged out from the paper discharge port 32 is formed between the inner circumferential surface of the upper cover 102 and the upper circumferential surface of the paper guide member 114 and between the inner circumferential surface of the upper cover 102 and the outer surface of the guide sheet 120.

The extending end of the paper guide path 118 corresponding to the lower end of the guide sheet 120 is connected to a paper guide path 136 formed between the lower surface of the paper holder 13 and the inner bottom surface of the lower cover 104, between the lower surface of the card cover 26 and the inner bottom surface of the lower cover 104, and between the lower surface of the distal end portion of the main body case 1 and the inner bottom surface of the lower cover 104.

The printed recording paper 2 discharged out from the paper discharge port 18 is housed in the paper guide paths 118 and 136 covered by the upper cover 102 and lower cover 104 of the water-drop proof cover 100. Thus, even if the portable information terminal of the second embodiment is used outdoors in rainy weather and the printed recording paper 2 is long size, the printed recording paper 2 is not wetted by rain drops.

In the water-drop proof cover 100, the upper cover 102 is rotationally connected to lower cover 104 by the cover hinge 106. Thus, it is unnecessary to remove the whole of the water-drop proof cover 100 from the distal end portion of the main body case 1, the paper holder 3 and the holder cover 25, when a new roll of the recording paper 2 is loaded in the paper holder 3. This facilitates the loading of the new roll of the recording paper 2 in the paper holder 3.

Since the waterproof seal members 112 are attached on the edges of the upper cover 102 and lower cover 104 of the water-drop proof cover 100 to be intimately in contact with each other and the outer surface of the distal end portion of the main body case 1, the water-drop proof cover 100 can provide a sufficient water-drop proof performance even though the upper cover 102 and lower cover 104 are rotatably connected by the cover hinge 106.

The paper guide paths 118 and 136, which are formed between each of the upper paper guide member 114 attached on the upper surface of the holder cover 25, the guide sheet 120 hanging down from the rear or distal end of the upper paper guide member 114, the lower paper guide member 124 provided on the rear end portion (the distal end portion) of the inner bottom surface of the lower cover 104 and the crescent-shaped paper guide ribs 126 provided at the corner of the rear end portion (the distal end portion) of the inner bottom surface of the lower cover 104, and each of the inner circumferential surfaces of the upper and lower covers 102 and 104 of the water-drop proof cover 100, ensure the smooth movement of the printed recording paper 2 discharged from the paper discharge port 32 in the upper surface of the distal end portion of the main body case 1, and prevents the jamming of the printed recording paper 2 in the water-drop proof cover 100.

Further, it is possible to save the energy consumption of the of a rotation driving source such as a motor (not shown) for rotating the platen roller 17 housed in the distal end portion of the main body case 1, so that the life of the battery used in the portable information terminal according to the embodiment of the invention is prolonged.

In the above described embodiment, the portable information terminal is explained as an example of a portable electronic apparatus. But, the portable electronic apparatus according to the invention is not limited to this, and may be, for example, any other portable electronic apparatus having a printer such as a PDA (Personal Digital Assistant).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A portable electronic apparatus comprising:

a main body including a first surface, a second surface positioned at an opposite side of the main body with respect to the first surface, and a recording paper discharge port formed in the first surface;

a printer portion including a printing head for printing information on a recording paper, the printed recording paper being discharged from the recording paper discharge port in the first surface of the main body; and a water-drop proof cover which is removably attached on the main body, and which covers a portion of an outer surface of the main body that faces the printed recording paper discharged from the recording paper discharge port and that includes a portion of the first surface and a portion of the second surface, such that the water-drop proof cover houses the printed recording paper discharged from the recording paper discharge port; and a paper guide member which is detachably attached to the main body, and which guides the printed recording paper discharged from the recording paper discharge port along an inner circumferential surface of the water-drop proof cover;

wherein the water-drop proof cover comprises: (i) an upper cover which covers said portion of the first surface of the main body, and (ii) a lower cover which covers said portion of the second surface of the main body, and wherein the upper cover and lower cover are rotatably connected to each other by a hinge;

wherein the paper guide member includes: (i) an outer circumferential surface which faces an inner circumferential surface of the upper cover of the water-drop proof cover, and (ii) two side surfaces positioned at respective sides of the outer circumferential surface, and wherein projections are provided on the two side surfaces of the paper guide member;

wherein cover guide ribs are provided on two side surfaces of the upper cover positioned at respective sides of the inner circumferential surface of the upper cover; and wherein the cover guide ribs of the upper cover slide on the projections of the paper guide member to widen a distance between the two inner side surfaces of the upper cover while the upper cover is rotated around the hinge.

2. The portable electronic apparatus according to claim 1, wherein a free end of each of the upper and lower covers is provided with a waterproof seal member that intimately contacts said portion of the outer surface of the main body when the upper and lower covers are closed with respect to each other.

3. The portable electronic apparatus according to claim 1, further comprising a guide sheet which is provided on the paper guide member, and which guides the discharged printed recording paper from the first surface of the main body to the second surface of the main body along the inner circumferential surface of the waterdrop proof cover.

4. The portable electronic apparatus according to claim 1, wherein a paper guide rib is provided on a corner of a part of the lower cover, and the paper guide rib bends the discharged printed recording paper at substantially a right angle to guide the discharged printed recording paper along said part of the lower cover.

* * * * *